United States Patent [19]

Kamikura et al.

[11] 4,085,597

[45] Apr. 25, 1978

[54] KNITTING MACHINE COUPLED WITH THE PROGRAM READING DEVICE

[75] Inventors: Shigeo Kamikura; Hideaki Itagaki; Yutaka Kagaya; Ryoiti Kawaoka, all of Kodaira, Japan

[73] Assignee: Silver Seiko Co., Ltd., Tokyo, Japan

[21] Appl. No.: 737,433

[22] Filed: Nov. 1, 1976

[30] Foreign Application Priority Data

Nov. 4, 1975 Japan ..... 50/131534
Feb. 21, 1976 Japan ..... 51/17487

[51] Int. Cl.[2] ..... D04B 7/00; D04B 15/66
[52] U.S. Cl. ..... 66/75.2; 66/154 A
[58] Field of Search ..... 66/154 A, 60, 64, 75.2, 66/75 A

[56] References Cited

U.S. PATENT DOCUMENTS

| | | | |
|---|---|---|---|
| 3,035,426 | 5/1962 | MacQueen | 66/75 A |
| 3,783,642 | 1/1974 | Haddam | 66/75 A |
| 3,786,655 | 1/1974 | Krause | 66/154 |
| 3,805,558 | 1/1974 | Protti | 66/75 A |
| 3,885,405 | 5/1975 | Bartels | 66/154 A |
| 3,896,638 | 7/1975 | Gottschall et al. | 66/50 R |
| 3,913,353 | 10/1975 | Spencer | 66/75 A |
| 3,913,354 | 10/1975 | Kohler et al. | 66/154 A |
| 3,924,244 | 12/1975 | Morat | 66/154 A |
| 3,983,718 | 10/1976 | Kahan et al. | 66/75.2 |
| 3,991,592 | 11/1976 | Kahan et al. | 66/75.2 |

*Primary Examiner*—Ronald Feldbaum
*Attorney, Agent, or Firm*—Armstrong, Nikaido, Marmelstein & Kubovcik

[57] ABSTRACT

A new type of hand-operated knitting machine having a device for reading knitting programs is provided. Unlike the conventional reading device-equipped knitting machine, the reading device is not mounted on its carriage. Therefore, although the scanning operation of the reading device is associated with the start of the carriage movement, it is not disordered by irregular carriage handlings, thus realizing proper reproduction of the knitting pattern.

21 Claims, 24 Drawing Figures

KNITTING MACHINE COUPLED WITH THE PROGRAM READING DEVICE

BACKGROUND OF THE INVENTION

This invention relates to means for selecting needles of a knitting machine, especially a hand knitting machine, according to a program, and more particularly to a system for providing electric signals representative of data for needle selection in a course of knitting according to a program. More specifically, the present invention relates to and is an improvement of the program providing means disclosed in patent application Ser. No. 686,380 in U.S.A. entitled "A method and apparatus of selecting needles of a knitting machine", and assigned to the assignee of the instant patent application.

The selection of knitting needles is required to achieve different knitting patterns and weaving effects. Since the manual selection of the knitting needles is both difficult and time consuming, and makes the operation of a knitting machine considerably more difficult, automatic selection of knitting needles was undertaken by which means the knitting machine was greatly simplified, and without any special act on the part of the person operating the machine, facilitated knitting of very diverse patterns.

For this purpose, several automatic needle selection mechanisms have been already proposed which employ electromagnetic means such as an electromagnet which may preferably be mounted on a carriage and is adapted to be selectively energized in accordance with a needle selection program. A needle selection program is provided by a program providing means which comprises a program carrier having a program of a pattern to be knitted thereon and is adapted to read the program to provide electric signals representative of data for needle selection. The program carrier may be a well-known punch card or a program sheet made of paper or plastics material upon which a pattern or design has been drawn in continuous contour lines or by colored areas.

In a hand-operated home knitting machine, it is required to mount a program carrier on the needle bed or the carriage so as to leave it in the eyesight of a machine operator so that she can visually confirm at any time the program she is currently knitting. Such confirmation is absolutely necessary when corrective- re-knitting must be performed, as a result of incorrect knitting. U.S. Pat. No. 3,885,405 discloses a program providing means in which a program carrier can be inserted alongside the needle bed in an intermittently feeding card holder to be fed from line to line and is directly scanned by a reading head mounted on the carriage when the carriage traverses the program carrier. The afore-mentioned Patent Application also discloses a program providing means in which, however, a reading head is mounted alongside the needle bed for movement in a predetermined path between two end positions and adapted to be moved therebetween by the carriage itself, means being provided for releaseably accompanying the carriage with the reading head.

However, the movement of the reading head is directly related to the movement of the carriage in either of the above-described program-providing means. In scanning the program carrier, it is always necessary to traverse the carriage. Such an operation is troubesome. Further, when the reading head reads the program, there is a difference between reading during the movement in one direction and reading during the movement in the other direction, which leads to inaccurate reading. If the carriage is stopped midway or reversed and moved in the opposite direction while the reading head is traversing, the reading may be mistaken.

SUMMARY OF THE INVENTION

Therefore, a primary object of this invention is to provide a program-providing system in which a reading head is driven by an electric motor which can be controlled independently of the movement of the carriage whereby the operation of a hand knitting machine is made easier.

Another object of this invention is to provide a program-providing system in which a linear motor is used as said electric motor to increase scanning speed to a very high level (120 strokes/minute).

A further object of this invention is to provide a program-providing system in which only the output signals of the reading head associated with a particular moving direction are used as effective signals to make reading more accurate.

Still another object of this invention is to provide a program-providing system which can be easily operated when pattern knitting is begun or re-knitting of incorrect knitting is required.

A still further object of this invention is to provide a program-providing system in which the feeding of a program carrier is controlled in terms of informations carried on the program carrier itself, whereby knitting of a vertical mirror repeat may be more conveniently carried out.

According to this invention, there is provided a program-providing system for providing electric signals representative of data for selecting knitting needles in a needle bed of a knitting machine which has a carriage slidable on the needle bed, comprising, in combination, a frame mounted alongside the needle bed; a holder rotatably supported on said frame; a program carrier removably supported on said holder and having a program of a pattern to be knitted thereon; a first drive means including an electromagnetic means for driving said holder to rotate around its axis thereby to incrementally feed the program carrier in one or the other direction; a guide bar mounted in parallel with said axis; a member slidably mounted on said guide bar; a scanning sensor mounted on the slidable member for reading the program on said program carrier; a second drive means including an electric motor for driving said slidable member to move from one to the other stroke end or vice versa; pulse generator means for generating an interval pulse when said slidable member moves a predetermined distance; and control means including a control circuit for controlling said first and second drive means whereby feeding of the program carrier in a preselected direction and/or scanning by the scanning sensor is effected in response to movement of the carriage.

BRIEF DESCRIPTION OF THE DRAWINGS

These and other objects and advantages of this invention will be easily understood from the following description of embodiments with reference to the accompanying drawings in which.

DETAILED DESCRIPTION OF THE PREFERRED EMBODIMENTS

Figure 1:
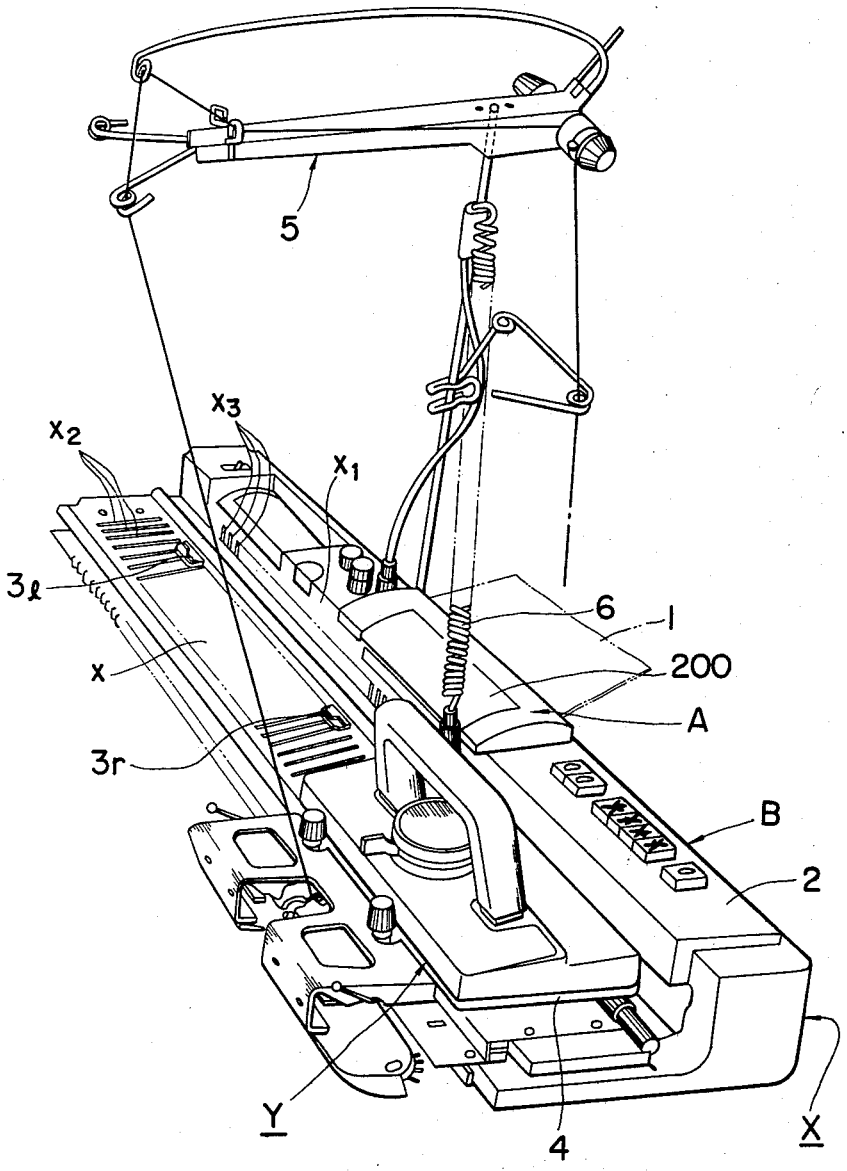
FIG. 1 is a schematic perspective view of a hand knitting machine to which a program providing system of the invention is applied.

Referring to the drawings, FIG. 1 shows a schematic perspective view of a hand knitting machine to which a first embodiment of a program providing system according to the invention is applied. In this specification, the side of the knitting machine facing the operator is called the front side and the opposing side, the rear side.

A body of the knitting machine generally designated by character X has a needle bed *x*. Behind the needle bed *x*, the body X is provided with a reading device A which comprises feeding means capable of carrying and feeding an information record carrier in the form of a knitting program card 1 and scanning means for optically scanning the information recorded on the card (not shown in FIG. 1) and a control box B which comprises various manually operating buttons arranged on a control panel 2 for manually operating the corresponding mechanisms (to be described hereinafter) and various electric and electronic circuits built in under the panel. On the needle bed *x* is positioned a pair of boundary members 3*l* and 3*r* which are shiftable in the longitudinal direction of the needle bed *x*. A range in which needle selection is effective (needle selection range) can be defined by setting the boundary members 3*l* and 3*r* at desired positions on the needle bed *x*.

A carriage Y is mounted for lateral sliding movement on the needle bed *x*. The carriage Y has a base member 4 and includes a cam mechanism known per se and provided on the underside of the base member and a pair of (left and right) needle selection mechanisms (not shown) also provided on the underside of the base member with a predetermined spacing therebetween along the longitudinal direction. Both of the left and right needle selection mechanisms are adapted to select necessary needles from the needles aligned in the needle bed *x* by the action of electomagnetic force in response to electric signals obtained by scanning a knitting pattern on the program card 1.

The reading device A is adapted to scan the card 1 automatically by means of the scanning means immediately after the moving direction of the carriage has been reversed and to generate the corresponding electric output signals. The output of the reading device A is connected to a suitable electronic component built in the body X, in which the electric signals are processed in a suitable form. Further, the electrical connection between the electronic component in the body X and other electronic components of the left and right needle selection mechanisms is provided by a cord 6 suspended from a tension member 5 for giving proper tension to a yarn. Accordingly, signals which are obtained by scanning the card 1 are processed and transmitted to the needle selection mechanisms through the associated electronic components and the cord 6. The boundary members 3*l* and 3*r* and the needle selection mechanisms are operatively connected so that when the carriage Y is traversed to the left or the right beyond either of the boundary members 3*l* and 3*r*, only the needles present between the boundary members may be subjected to needle selection (except for the needles at rest positions).

A significant construction of the reading device A will be described below, referring to FIGS. 2 through 6.

Figure 3:
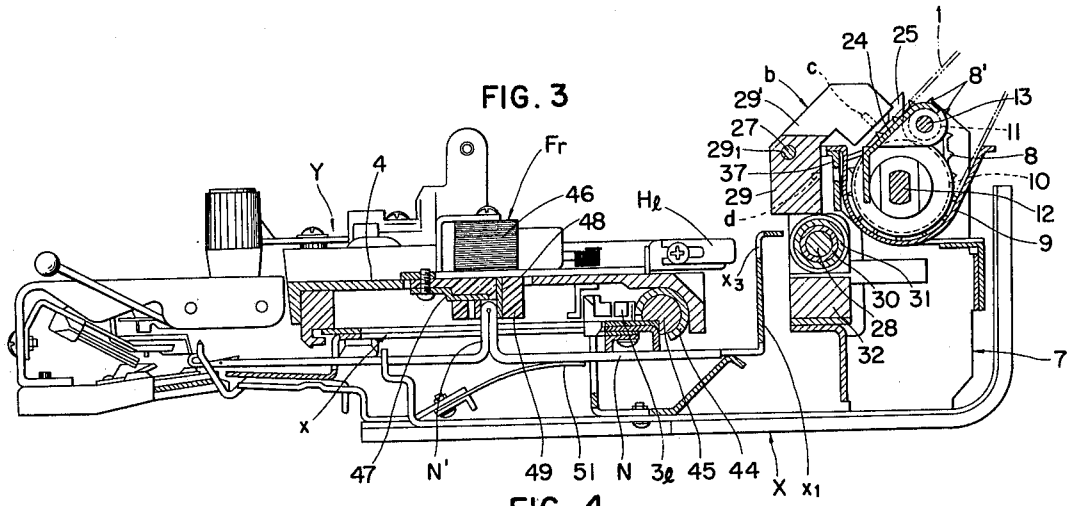
FIG. 3 is a vertical cross section of the knitting machine including the feeding device, a scanner, and a carriage.

The reading device A as a whole is mounted on a frame 7 (this frame consists of a plurality of members in practice, but is herein regarded as an integral assembly) behind a standing wall $x_1$ disposed at the rear end of the needle bed *x* (see FIG. 3). As described above, the reading device A comprises the feeding means and the scanning means. First of all, the program carrier feeding mechanism, that is, the feeding means for carrying and feeding the knitting program card 1 will be explained.

Between lateral side walls 7' of the frame 7 are supported for rotation a lower shaft 12 and an upper shaft 13 disposed parallel thereto. The upper and lower shafts 12 and 13 are provided with geared pulleys 10 and 11 at either end thereof, respectively. Timing belts 8 are installed on the respective adjoining pulleys 10 and 11 so as to enclose the outer opposing peripheries of the pulleys. The inner surface of each belt 8 is engraved with teeth which ensures the engagement with the pulleys so that the rotation of the shaft 12 is synchronously transmitted to the belts 8. Further, each belt 8 is provided at the outer surface with protrusions 8' which will engage with perforations 1' aligned at the left and right sides of the card 1. This means that the belts 8 are sprocket belts and serve as feeding members to feed the card 1 in the direction of the perforation alignments upon the rotation of the lower shaft 12.

Figure 6:
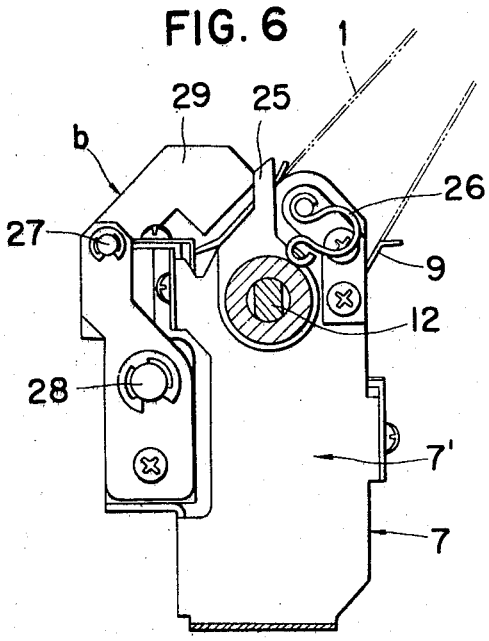
FIGS. 6 and 7 are cross sections taken on line VI—VI and VII—VII in FIG. 2, respectively.

In order to guide the program card 1, a card-guiding plate 9 is longitudinally extended between the side walls 7' of the frame 7 and is transversely curved in a circular shape concentric with the large pulleys 10 in the lower half thereof. Thus, it is nearly U-shaped as shown in the cross sectional view of FIG. 3. To the same end, a card-supporting plate 24 which is laterally extended between the side pulleys 11 and card-supporting sub-plates 24' which are positioned outside the pulleys 11 and are flush with the plate 24, but have only a small length in the lateral direction, are pivotally mounted on the upper shaft 13. As shown in FIG. 3, the surface of the supporting plate 24 presents a slant plane circumscribing the front peripheries of the pulleys 10 and 11. In addition, card-restraining members 25 adapted to lightly restrain the left and right side edges of the card 1 against the sub-plates 24', respectively, are pivotally mounted on the shaft 12. The right restraining member 25 is shown in FIG. 6 which is a cross section taken on line VI—VI of FIG. 2. Each restraining member 25 can be pivotally moved or opened and closed with respect to a pivot point on the axis of the shaft 12 and is usually biased toward the rear side or in the closing direction by a spring 26 bridged between the shaft 13 and a jaw of the restraining member.

The loading of the knitting program card 1 on the above-described feeding means is achieved by placing the card 1 from behind the body X on the supporting plate 24 and the sprocket belt 8 and inserting both sides of the card between the supporting sub-plates 24' and the restraining members 25. It is necessary to ensure the correct engagement of the left and right perforations 1' of the card 1 with the protrusions 8' of the sprocket belts 8. Thereafter, the card 1 is transferred by the sprocket belts 8 along the curved inner or upper surface of the guiding plate 9, moved upwardly along the flat surface of the guiding plate 9 and then released. In the course of card transfer, the card 1 is lightly pressed against the sub-plates 24' by the restraining members 25 on both sides so that the card is moved along the slant plane of the supporting plate 24 in close contact therewith. When viewed from the direction of FIG. 3, the card 1 is held and fed in an oblique, nearly U-shaped manner.

Figure 2:
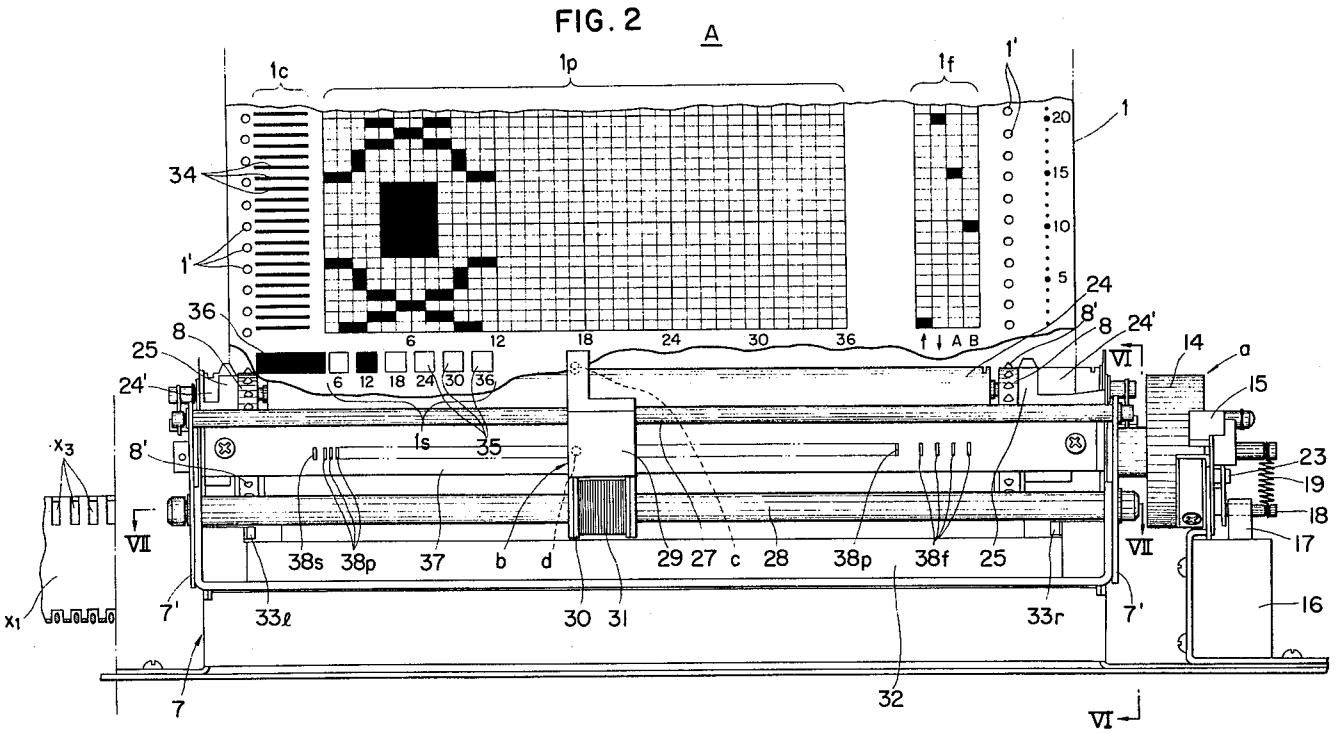
FIG. 2 is a front view of a feeding device according to a first embodiment of this invention and a knitting program card to be loaded thereon.
Figure 4:
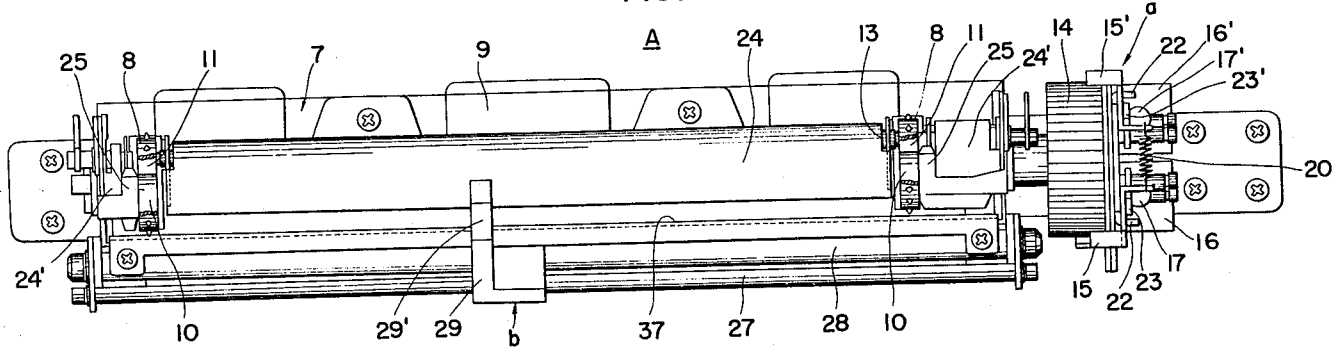
FIG. 4 is a plan view of the feeding device of FIG. 2.
Figure 5:
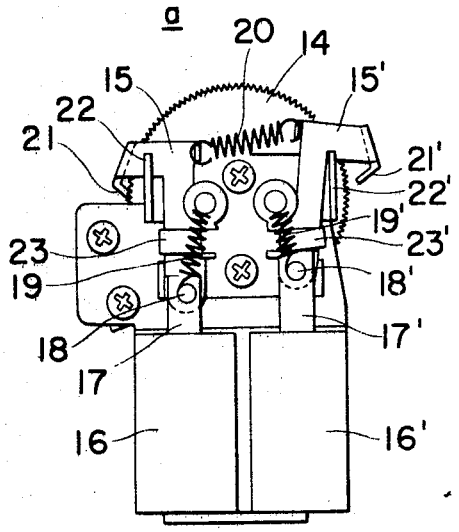
FIG. 5 is a side elevation view of the feeding device, particularly a driving mechanism, of FIG. 2.

A mechanism *a* for driving the feeding means is shown in FIGS. 2, 4 and 5.

The lower shaft 12 is extended over the side wall 7' at the right end in FIGS. 2 and 4. To this extension of the shaft 12 is fixed a ratchet wheel 14 which is one of components of the driving mechanism *a*. On the front and rear sides of the ratchet wheel 14 there are positioned a forward feeding member 15 and a backward feeding member 15' which are connected to plungers 17 and 17' of electromagnets 16 and 16' by pivots 18 and 18', respectively. The feeding members 15 and 15' are upwardly biased by springs 19 and 19' which are bridged between the pivots 18 and 18' and pins fixed to the frame, respectively, and also biased to each other by a spring 20 which are bridged between jaws of the members, so that the feeding members are normally lifted to an upper retracted position where extreme ends or pawls 21 and 21' of the members may not engage with the ratchet wheel 14.

The ratchet wheel 14 may be driven forward or backward by alternatively actuating the electromagnet 16 or 16'. Upon actuation of one of the electromagnets through the application of an electric pulse signal, the corresponding plunger 17 or 17' is lowered. Accordingly, the corresponding feeding member 15 or 15' is lowered along guide members 22, 23 or 22', 23' and is eventually engaged with the ratchet wheel 14. As a result, the ratchet wheel is advanced by one tooth. Accordingly, if the electromagnet 16 is actuated, the shaft 12 is rotated counterclockwise in FIG. 3 so that the card 1 is fed forward by an increment corresponging to a one-tooth advance of the ratchet wheel 14. On the other hand, if the electromagnet 16' is actuated, the card is fed backward by the same increment.

Instead of the above-described electromagnets 16 and 16' and the associated linkages, a bi-directional pulse or step motor may be employed or rather be preferable for driving the shaft 12 (This embodiment will be described hereinafter).

Now, the scanning means for scanning the card 1 supported in the above-described manner will be explained.

Between the front edges of the side walls 7' are extended a pair of guide bars 27 and 28 which are positioned one on the other and parallel with the shafts 12 and 13. A scanner *b* is mounted for sliding movement on these guide bars 27 and 28.

The scanner *b* comprises a body in the form of a runner 29 having a through hole $29_1$ which is slidably fitted on the upper guide bar 27 and a bobbin 30 which is integrally connected to the lower portion of the runner 29 and is also slidably fitted on the lower guide bar 28.

The bobbin 30 has a coil 31 wound thereon. Further, an elongated permanent magnet 32 is placed just below the lower guide bar 28 in a parallel relation. The permanent magnet is attached to the horizontal part of the frame 7 so as to extend between the side walls 7'.

This permanent magnet 32 has its north pole at the upper side and its south pole at the lower side along the entire length thereof. The lower guide bar 28 and the horizontal part of frame 7 underlying the magnet 32 are made of ferro magnetic material. Upon supplying electric current to the coil 31, this current traverses the constant magnetic field generated by the permanent magnet 32. The electromagnetic force resulting from the interaction between the coil and the magnet has the function of moving the runner 29 and hence the scanner *b* to the left or the right along the guide bars 27 and 28, depending upon the direction of the current flow in the coil 31.

In other words, the coil 31 and the permanent magnet 32 constitute a kind of a linear motor in which the magnet 32 serves as a stator.

Figure 7:
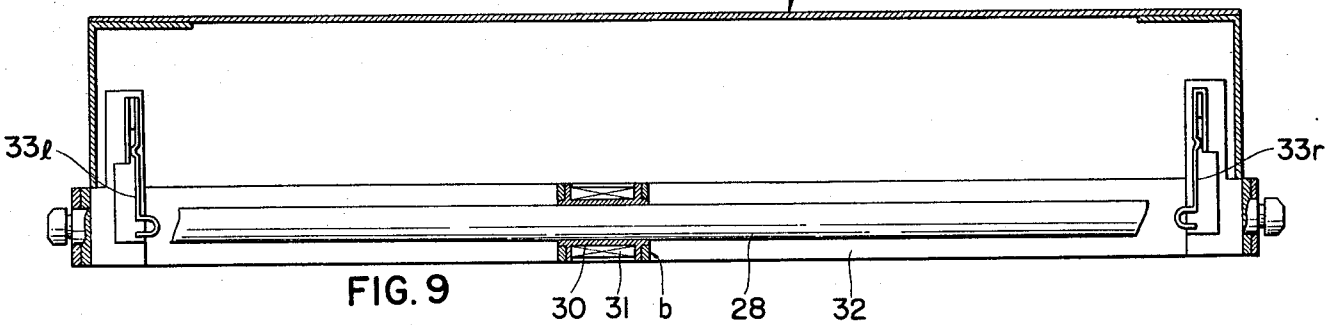

At the positions corresponding to the left and right ends of the permanent magnets 32, respectively, a left and a right limit switch **33*l* and 33*r* for switching the direction of current flow to be supplied to the coil 31 are provided as shown in FIG. 7 which is a cross section taken on the line VII—VII of FIG. 2**.

The left limit switch 33*l* is turned on when the scanner *b* runs to the left and collides with this switch, while the right limit switch 33*r* is turned on when the scanner *b* runs to the right and collides with this switch. The scanner *b* is automatically moved in a reciprocating manner between the left and right limit switches 33*l* and 33*r*. Accordingly, the left and right limit switches serve to define the ends of a stroke of the scanner. As will be described in detail hereinafter, the scanner *b* is normally positioned at the left stroke end as its starting position. Upon the arrival of an actuating signal in response to the reversal of the carriage Y, electric current is supplied to the coil 31. At this instant, the scanner *b* starts to move and runs at a remarkably high speed from the starting position to the right stroke end, instantaneously reverses its moving direction at this stroke end and returns to the starting position at the same speed. In this manner, the left and right limit switches 33*l* and 33*r* also serve as detecting means to detect whether the scanner *b* is in the starting position or in the reverse position (right stroke end).

The runner body 29 of the scanner *b* has an upper extension 29' which is extended obliquely to the rear, first upward and then downward, as shown in FIGS. 2 and 3. The extreme portion of the extension 29' is placed in close relation to the slant plane of the card-supporting plate 24. A photoelectric sensor *c* is built in this facing portion of the extension 29', which sensor comprises an emitting element capable of emitting a light to the surface of the card 1 and a sensing element capable of receiving the reflected light from the surface and converting it into an electric signal (these elements are not shown in the drawings because they are well known in the art).

While the scanner *b* runs along the guide bars 27 and 28, the photoelectric sensor *c* scans the card 1 supported on the plate 24 along a straight path or scanning line. In this specification, the photoelectric sensor *c* is referred to as a scanning sensor, hereinafter.

In this embodiment the reading device is of an open construction. A transparent hood 200 of a suitable synthetic resin in placed on the reading device A, as shown in FIG. 1, so that the operator can visually confirm the part of the card 1 which is in the scanning position.

The knitting program card 1 which can be employed as the knitting information record carrier according to the invention will be described with reference to FIG. 2. The card 1 may be a sheet of ordinary white paper or a semi-transparent film of synthetic resin such as polyester. This card 1 is provided with a number of perforations 1' aligned at the both sides thereof. The white surface portion of the card between the left and right perforations 1' includes a knitting pattern region 1*p* where a desired knitting pattern representing knitting pattern informations is to be recorded and a function mark region 1*f* where desired function marks representing knitting function informations are to be recorded. Both regions are divided into sections. In a preferred example, horizontal and vertical lines have been printed in a non-sensitive color that the light sensing element cannot discriminate. The surface portion of the card also includes a feed control mark region 1*c* positioned at the left end of the knitting pattern region 1*b*, on which region a plurality of feed control marks 34 representing informations for controlling the feeding of the card through reading by the scanning sensor *c* have been printed. For example, these marks may take the form of comparatively thick, black elongated lines which are arrayed in parallel at a constant interval in the direction of alignment of the perforations 1'. Spaces between the regions 1*p* and 1*f* and the regions 1*p* and 1*c* are blank.

The knitting pattern region 1*p* is so divided that the vertical lines divide the adjoining stitches and the horizontal lines divide the adjoining knitting rows, the vertical and horizontal lines defining unit sections. Below the region 1*p*, numerals representing the number of stitches are printed in the non-sensitive color.

More illustratively, each section in the knitting pattern region 1*p* corresponds to one stitch. Each column of sections aligned in the vertical direction corresponds to a wale, while each row of sections aligned in the horizontal direction corresponds to a course (knitting row). For example, it is assumed that the so-called unit pattern including *n* stitches or wales as a unit group is knit. In this case, the leftmost vertical line or reference line and the *n*th vertical line spaced apart rightward therefrom are regarded as boundary lines. A desired picture (knitting pattern) corresponding to the unit pattern can be drawn on an area defined between the boundary lines by means of a suitable drawing tool such as a pencil. In the drawing, such a picture is inked in black all over.

For example, when an operation for knitting the unit pattern consisting of 12 stitches in a horizontal row is intended by selecting 12 needles as a unit group, the corresponding picture can be drawn on an area defined between the reference line and the 12th vertical line spaced apart therefrom. Of course, the profile of the picture should be within the predetermined area.

When drawing the picture, it is not necessary to ink in the unit sections enclosed within the profile of the picture one by one. It may be preferable to ink in the unit sections all together, because each unit section will be accurately sampled out during the scanning of the pattern, which will be explained hereinafter.

The function mark region 1*f* is also divided by horizontal lines in line with the corresponding horizontal lines in the knitting pattern region 1*p* and vertical lines parallel with the vertical lines in the region 1*p*. The number of rows or number of unit sections in a column in the function mark region 1*f* is equal to that in the knitting pattern region 1*p*, while the number of columns or number of unit sections in a row is less than that in the region 1*p*. In this example, the knitting pattern region 1*p* has 36 unit sections in a row, while the function mark region 1*f* has only four unit sections in a row.

In FIG. 2, the region 1*f* has four columns of unit sections in which the leftmost column is designed for programing the forward feed of the card 1, the adjoining column is designed for programing the backward feed of the card and the remaining two right-hand columns are designed for programing other desired functions, for example, switching on a buzzer to inform the exchange of yarn or the initiation or completion of needle selection. If a certain function is desired, an appropriate unit section in the function mark region 1*f* may be marked or inked in black.

As described in the above, the region 1*c* contains feed control marks 34 which are aligned on the extensions of the horizontal lines passing the centers of sections in the respective rows of the knitting pattern region 1*p*. The card is automatically fed row by row in accordance with the marks 34.

In addition to the above three record regions, there is another region in the card 1. This is a unit number region 1*s* for programing the unit number of needles to be selected, which is printed below the knitting pattern region 1*p* in the non-sensitive color.

The region 1*s* includes a required number of squares 35 aligned horizontally at a certain interval. Each square is appointed to a different predetermined unit number of needles. The unit number is increased by a predetermined number from left to right one after the other. Numerals representing the unit are printed below the respective squares 35 in the non-sensitive color. In this case, the region 1*s* has six squares 35 in total. The leftmost square is appointed to a unit number of needles to be selected of "6", and the remaining squares from left to right are appointed to unit numbers of "12", "18", "24", "30" and "36", respectively, by an increment of 6.

This unit number region 1*s* is also scanned by the scanning sensor *c* of the scanner *b* so that the unit number of needles is determined by the marked square. For example, when the square appointed to a unit number of "12" is inked in black as shown in FIG. 2, pattern knitting is worked according to a unit pattern consisting of 12 needles.

The card 1 further includes an instruction mark 36 which is positioned at the leftend of the unit number region 1*s*. This instruction mark 36 is intended to send a preparatory signal for changing the associated electronic circuit into a state ready to set the unit number.

The instruction mark 36 may be, for example, an elongated black strip which is positioned in the extension of the squares 35 of the unit number region 1*s* in the horizontal direction and straight below the feed control marks 34 of the region 1*c* in the vertical direction. The strip 36 has a width equal to that of the squares of the unit number region 1*s* and a length which is longer than that of the feed control marks 34 at the right side by the distance between the regions 1*c* and 1*p*.

The card 1 involving all the necessary instructions and informations has been explained. As described in the foregoing, the card 1 is inserted in the holding means so as to engage with the sprocket belts 8*l* and 8*r*. When the scanner *b* automatically travels between the starting position and the reverse position, the instruction mark 36 and the inked square in the unit number region 1*s*, or the feed control marks 34 in the region 1*c* and informations in the region 1*p* and 1*f* are be read. In this connection, it should be ensured that the scanning sensor *c* moving along its straight scanning line scans the card 1 between vertical lines P*l* and P*r* shown in FIG. 12.

It is necessary to sample the electric output signals from the scanning sensor *c* to obtain desired signals. The mechanical construction of a sampling mechanism which is used to sample the above-described output signals will now be described with reference to FIGS. 2 and 3.

Behind the runner 29 of the scanner *b*, a linear encoder in the form of an elongated plate 37 having a mirror-like (reflective) front surface is mounted on the frame 7, the plate 37 being parallel with the guide bars 27 and 28.

The linear encoder 37 is perforated with three kinds of slits 38*s*, 38*p* and 38*f* in alignment. One slit 38*s* for obtaining a signal for sampling only the instruction mark 36 on the card 1 is provided at a position corresponding to the blank space between the feed control mark region 1*c* and the knitting pattern region 1*p*. A predetermined number (in this case, 120) of slits 38*p* for obtaining signals for sampling the knitting pattern inked in the region 1*p* are successively provided from a position corresponding to the leftmost column of sections in the region 1*p* to a predetermined position extending beyond the rightmost line in the region 1*p*, the leftmost slit 38*p* being adjacent to the slit 38*s* and the subsequent parallel slits 38*p* being aligned in a straight line at a predetermined interval. Further, a predetermined number (in this case, four) of slits 38*f* for obtaining signals for sampling the function marks inked in the region 1*f* are successively provided in parallel with the preceding slits 38*p*, the leftmost slit 38*f* being adjacent to the rightmost slit 38*p* and each slit 38*f* corresponding to a column of sections in the function mark region 1*f*.

On the other hand, the runner 29 of the scanner *b* is provided with a sampling sensor *d* at the rear side thereof. This sampling sensor *d* is a photoelectric sensor for optically reading the above-described three kinds of slits 38*s*, 38*p* and 38*f* and consists of an emitting element capable of emitting light to the reflective surface of the linear encoder 37 and a sensing element capable of receiving the reflected light from the surface and converting it into an electric signal (these elements are not shown in the drawings because they are well known in the art).

The sampling sensor *d* is so designed that it can produce output signals or sampling pulses corresponding to the slits 38*s*, 38*p* and 38*f* when the scanner *b* travels along the guide bars 27 and 28.

Figure 18:
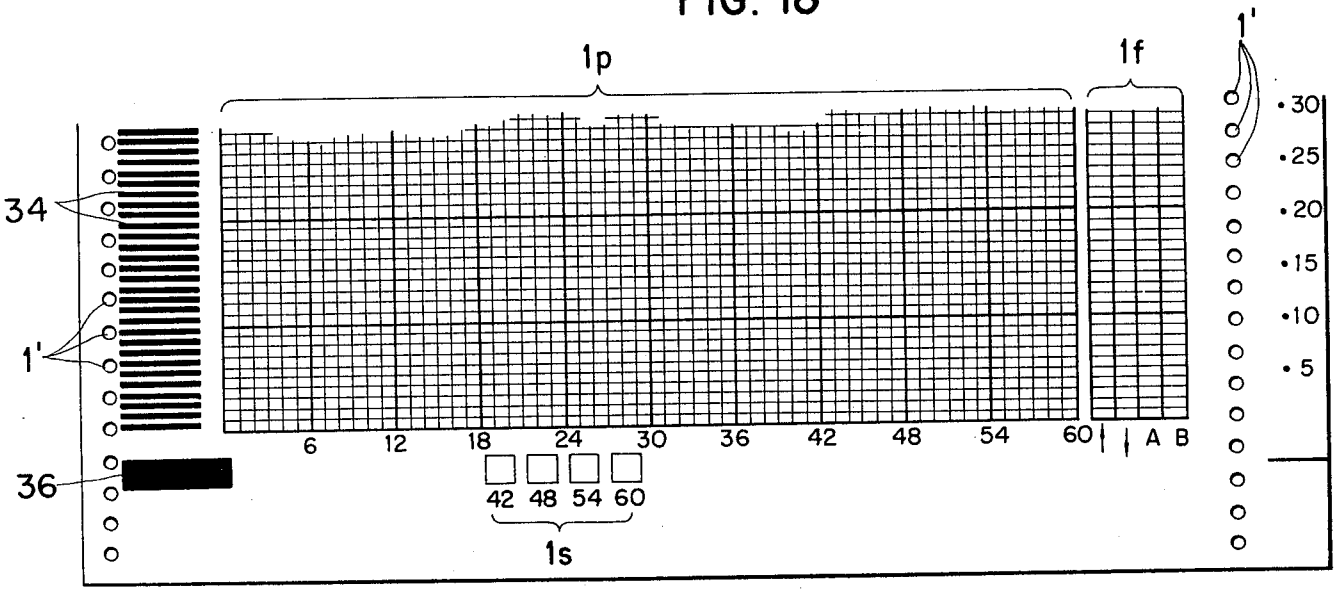
FIGS. 18 and 19 are plan views of lower parts of a second and a third program card different from the first program card of FIG. 2, respectively.

The number of the slits 38*p* for obtaining signals for sampling the knitting pattern is 120 so as to obtain 120 sampling pulses in this example, because even a card including "60" or "120" columns of sections in the knitting pattern region 1*p* (see, FIGS. 18 and 19) as well as the above-described card 1 including "36" columns may be used.

The reading device according to the invention is mechanically constructed in the above-described manner. The reading device is electrically so constructed that the driving mechanism *a* and the scanner *b* in the reading device A may be started in response to the movement of the carriage Y. More illustratively, the scanner *b* is started when forward one of needle selecting mechanisms F*l* and F*r* built in the carriage Y (and adapted to select needles during the after-reversal movement of the carriage Y) reaches a needle selection range after the carriage Y has reversed its direction of movement. Immediately after the scanner *b* has completed its scanning operation the driving mechanism *a* is started.

Figure 9:
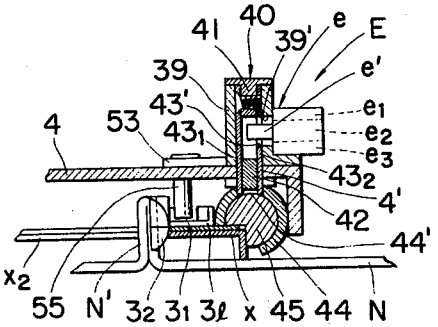
FIG. 9 is an enlarged cross section of a switch taken on the center line CL in FIG. 8.
Figure 8:
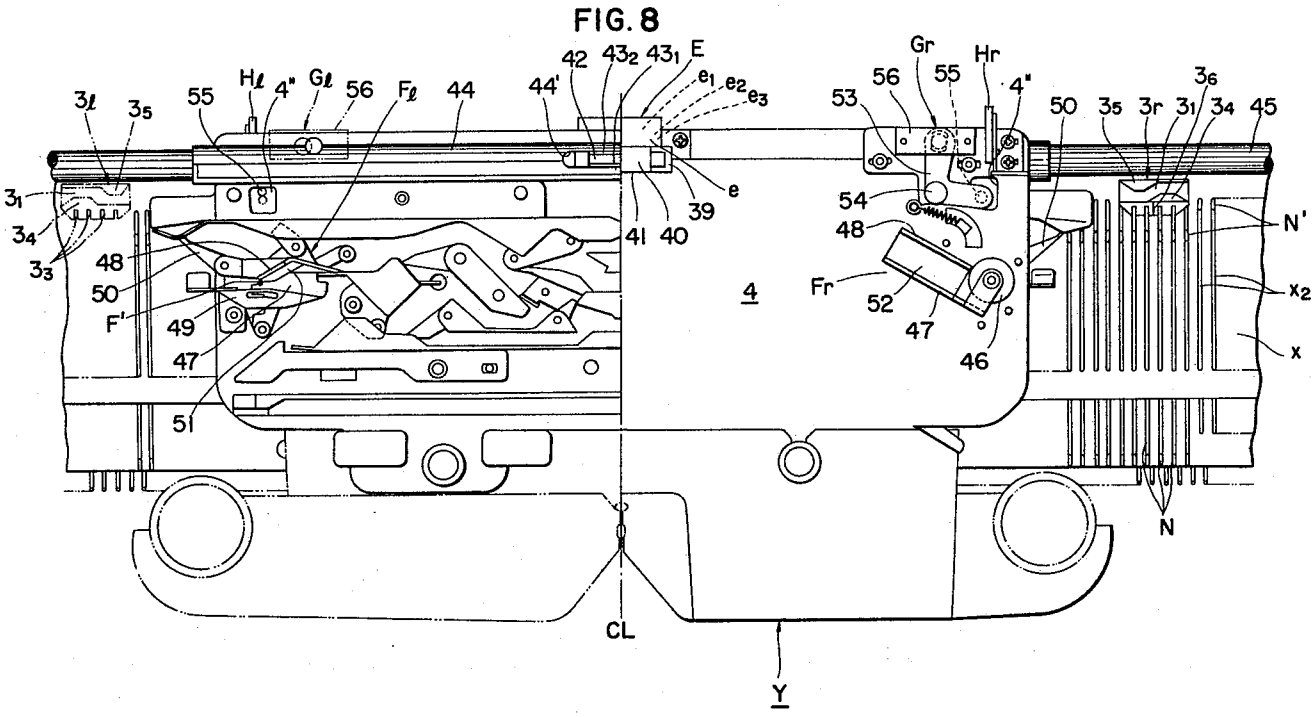
FIG. 8 is a plan view of part of a needle bed and a carriage mounted thereon, the right half of the carriage showing mechanisms on the upper portion of a base member, and the left half showing a cam mechanism under the base member.

FIG. 8 is a plan view of the carriage Y, in which the right half shows mechanisms on the upper surface of the base plate 4 (a cover has been taken away) and the left half shows mechanisms under the base plate (the base plate has further been taken away). FIG. 9 is an enlarged cross section taken on the center line CL of FIG. 8.

The carriage Y is provided with a switching mechanism E at the rear center thereof. This switching mechanism E responds to the reversal of the carriage Y and has the following construction.

To the rear center of the base plate 4 of the carriage Y is secured a rectangular box-like frame 39. A switch starter 40 is loosely fitted to the top of the frame 39 so that the starter may reciprocably slide along the lateral walls of the frame 39 within a predetermined range. The switch starter 40 comprises a T-shaped connecting member 41 adapted to slide along the top surfaces of the frame 39 and a magnet piece 42 securely interposed between a pair of magnetic plates $43_1$ and $43_2$. The connecting member 41, the magnet piece 42 and the magnetic plates 43 are firmly secured to form an integral body. The lower ends of the two magnetic plates $43_1$ and $43_2$ are extended downwardly through an elongated opening 4' formed in the base plate 4 and another elongated opening 44' formed in a slide pipe 44 which has a known structure and is secured to the base plate 4, and terminated at the position adjacent to a carriage guide rail 45 which has a known structure and is longitudinally placed on the needle bed *x*. The extreme lower ends of the magnetic plates 43 are always in contact with the rail 45 by magnetic attraction because the plates 43 are magnetized under the influence of the magnet 42 and the rail 45 is made of magnetic material.

On the other hand, a micro-switch *e* consisting of three switch parts $e_1$, $e_2$ and $e_3$ is secured to the rear side of the frame 39. A lever *e'* of the switch *e* is extended through a window 39' formed in the rear wall of the frame 39 and is inserted into an opening 43' formed in the rear magnetic plate $43_2$.

As described above, the switch starter 40 is permitted to freely slide along the side walls of the frame 39 within the predetermined lateral range and is attracted to the carriage guide rail 45. The starter 40 is first relatively moved in a sliding manner up to the right sliding limit in the frame 39 (more accurately, the starter is stationary and the frame is moved to the left) and is then carried to the left together with the frame by the carriage Y when the carriage Y is moved to the left. Alternatively, the starter 40 is first relatively moved in a sliding manner up to the left sliding limit in the frame 39 and is then carried to the right together with the frame by the carriage Y when the carriage Y is moved to the right. The movement of the switch starter 40 in relation to the frame 39 turns the lever *e'* to the right or the left to actuate the switch *e*.

Figure 15:
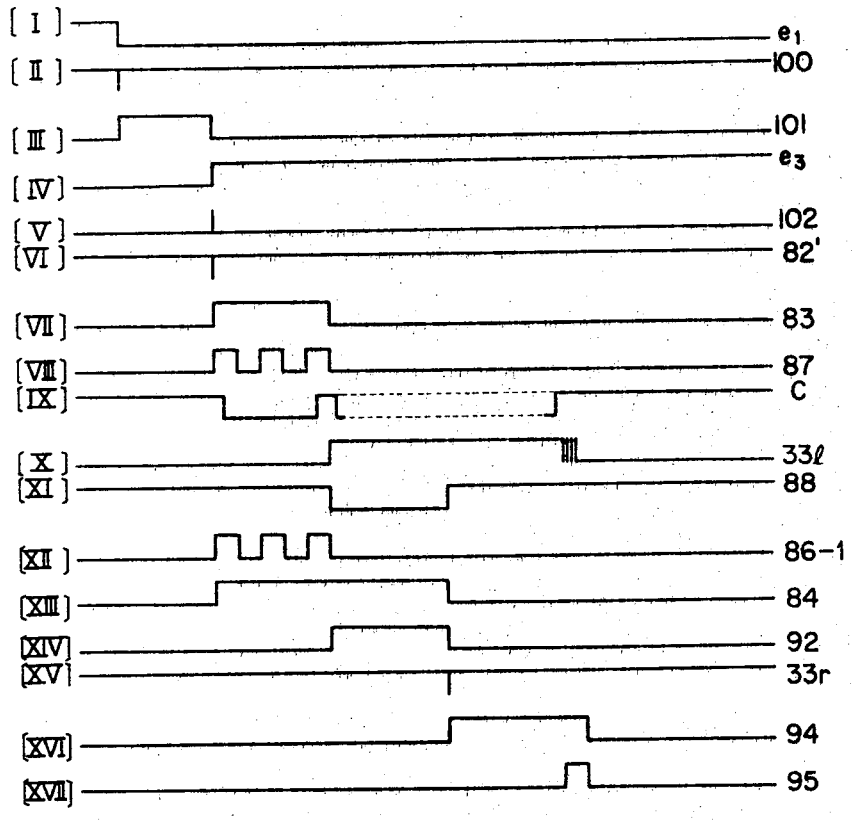

The first switch part $e_1$ of the switch *e* serves to detect the moving direction of the carriage Y. As shown in FIGS. 15 [I] and 17 [II], this switch part $e_1$ produces a two-value electric signal which represents the moving direction of the carriage Y and changes from "H" to "L" or conversely in response to the reversal of the moving direction of the carriage Y. It is obvious that, if the carriage Y is once stopped and then moved in an opposite direction, the signal will be changed after the carriage is started to move.

The second switch part $e_2$ of the switch *e* serves to selectively supply needle selection signals in the form of electric current, which has been transmitted from the scanner *b* to the carriage Y through the cord 6, to working one of the needle selecting mechanisms F*l* and R*r*. Each of the needle selecting mechanisms F*l* and F*r* comprises an electromagnet 46, a pair of magnetic members 47 and 48 which form a magnetic system with the electromagnet 46 and a butt N' of a needle and are magnetically excited in response to the excitation of the electromagnet 46 to selectively retract the associated needle by a short distance, and a parmanent magnet 52 for subsequently retracting the needle by an additional distance. The structure of the needle selecting mechanism is substantially the same as that disclosed in the above-described Patent Application, except that some modifications are made on several members including magnetic members 47 and 48. Besides this, a cam mechanism installed in the carriage Y including side cams 50 is substantially the same as that disclosed in the above-described Patent Application.

The third switch part $e_3$ is provided to selectively transmit electric output signals from a pair of mechanisms for detecting the needle selection range G*l* and G*r* (to be described in detail hereinafter) to the associated circuit through the cord 6 according to the moving direction of the carriage Y. The needle selection range detecting mechanisms G*l* and G*r* are symmetrical in construction with respect to the center line CL of the carriage Y as well as the other mechanisms mounted on the carriage Y. In FIG. 8, only the right detecting mechanism G*r* is illustrated in detail.

Each of the mechanisms G*l* and G*r* comprises a crank arm 53 which is mounted for horizontal rotation on the base plate 4 by a pivot 54. One end of the crank arm 53 is connected to a lever of a microswitch 56 attached to the base plate 4 so that the switch 56 is turned on or off depending upon the pivotal movement of the crank arm 53. To the other end of the crank arm 53 is anchored a pin 55. This pin 55 is extended from the underside of the arm 53 downward through an opening 4'' formed in the base plate 4 so as to engage with the boundary members 3*l* and 3*r* shiftably positioned on the needle bed *x* (see FIG. 9).

The boundary members 3*l* and 3*r* serve to define the range in which a desired pattern is to be realized in a knitted fabric. Needles N are fitted in side-by-side relation on the needle bed *x*. Either of the boundary members 3*l* and 3*r* is positioned on the needle bed *x* so that a given mark $3_6$ on the member may coincide with a boundary between the outermost one of the working needles within the portion where the pattern should be knitted or the range where the needle selection should be effected and the adjacent one of the remaining needles. In this condition, a desired number of needles N present between the marks $3_6$ on the boundary members 3*l* and 3*r* are subjected to selection.

The boundary members 3*l* and 3*r* not only serve to define the pattern knitting range, but also function as switch starters in combination with the mechanisms G*l* and G*r*.

Each of the switch starters 3*l* and 3*r* comprises a body which has a cam groove $3_1$ extending laterally from one end to the other on the upper surface, a plurality of projections $3_2$ extending downward from the front underside so as to tightly fit into needle paths $x_2$ from above, and a plurality of butt-receiving grooves $3_3$ formed in the front side so as to receive butts N' of needles N in a snug fit manner, respectively. The starters 3*l* and 3*r* can be placed at desired positions on the needle bed *x* in a stationary manner by fitting the projections $3_2$ into the needle paths $x_2$. Of course, the cam grooves $3_1$ of the two starter bodies are symmetrical with each other in this case. That is, in the left switch starter 3*l*, a front and a rear cam portion $3_4$ and $3_5$ which form a front and a rear side wall of the cam groove $3_1$ are situated at the left and the right, respectively, while vice versa in the right switch starter 3*r*.

When the carriage Y is moved to the left or right, the pins 55 of the micro-switches 56 of the switch mechanisms G*l* and G*r* are engaged with the cam grooves $3_1$ of the switch starters 3*l* and 3*r* and are guided along the cam portions $3_4$ and $3_5$. The micro-switches 56 are so set that the switches are turned on when they are within the range defined between the switch starters 3*l* and 3*r* and turned off when they are out of the range.

Figure 17:
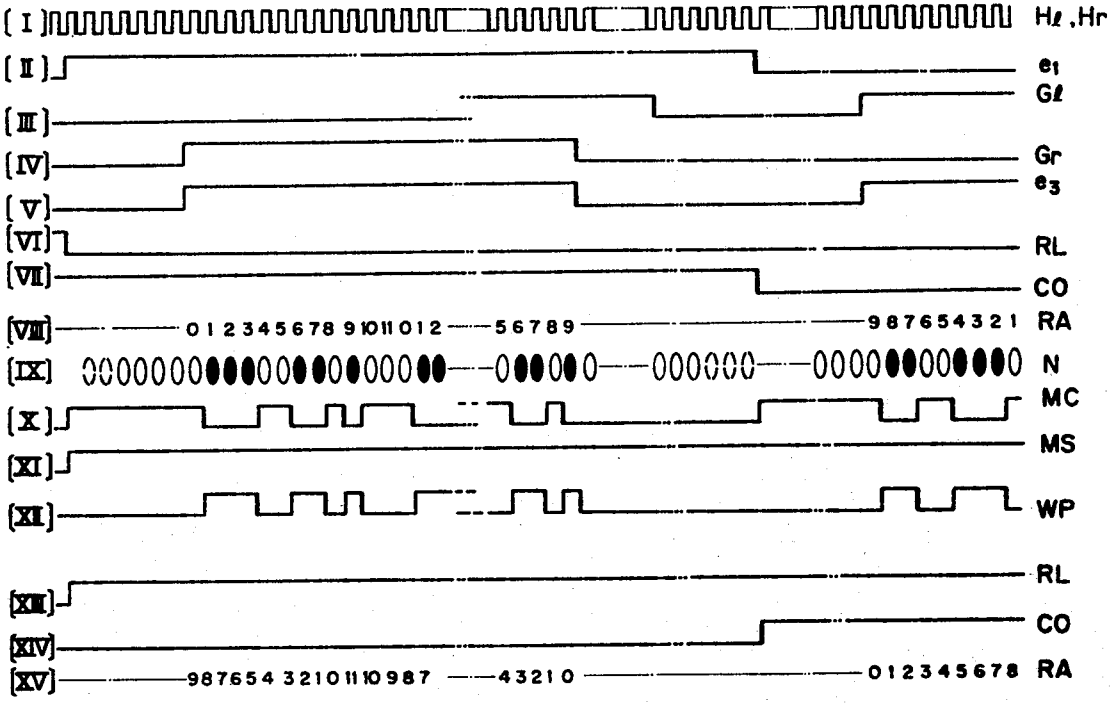
FIG. 17 is a time chart illustrating operations of the respective components of FIG. 16.

It is to be noted that the left and right pins 55 are positioned in the rear extension of the needle selection performing points F' of the left and right needle selecting mechanisms F*l* and F*r*. Accordingly, the left and right switch mechanisms G*l* and G*r* perform their switching action when the selection performing points F' of the needle selecting mechanism F*l* and F*r* reach the positions on the needle bed *x* which correspond to the switch starters 3*l* and 3*r*, respectively. As shown in FIG. 17 [III] and [IV], the left and right switch mechanisms G*l* and G*r* produce electric output signals which are changed from "H" to "L" or vice versa. By the selective action of the third switch part $e_3$ of the micro-switch *e*, only the effective signals which correspond to working one of the needle selecting mechanisms F*l* and F*r* are derived among the entire output signals from the left and right switch mechanisms G*l* and G*r*.

As shown in FIG. 17 [V], the third switch part $e_3$ for instructing the effective needle selection range is so designed that it produces an output signal "H" representing the effective needle selection range when the needle selection performing point F' of working one of the needle selecting mechanisms F*l* and F*r* which is ahead of the other in the moving direction of the carriage Y is within the range defined between the left and right switch starters 3*l* and 3*r*, or produces an output signal of "L" when the needle selection performing point F' is out of said range. Only when the output signal "H" is given, it is possible to selectively control the excitation and non-excitation of the electromagnet 46.

The micro-switch *e* further comprises a fourth switch part, though not shown. This fourth switch part is adapted to selectively derive outputs of a pair of timing pulse generators H*l* and H*r* for producing timing pulses representing the movement of the carriage Y. The timing pulse generators H*l* and H*r* may comprise the same photoelectric sensor as the above-described photoelectric sensors *c* and *d*. The photoelectric sensors H*l* and H*r* are attached to the rear side of the base member 4 of the carriage Y at positions corresponding to the respective left and right needle selecting mechanisms F*l* and F*r* (see FIGS. 3 and 8). In relation to the sensors H*l* and H*r* projecting rearwardly from the base member 4, the opposing standing wall $x_1$ disposed at the rear side of the needle bed *x* is provided with a number of slits $x_3$ each corresponding to each needle path $x_2$. The photoelectric sensors H*l* and H*r* moving together with the carriage Y can scan and read the slits $x_3$ as a linear encoder and produce timing pulses corresponding to the movement of the carriage Y as shown in FIG. 17 [I].

Among timing pulses generated from the left and right timing pulse generators H*l* and H*r*, only the timing pulses which correspond to working one of the needle selecting mechanisms F*l* and F*r* are derived as an effectove output by means of the fourth switch part of the switching mechanism E.

Now, the operation of this knitting machine will be described.

It is assumed that preparatory knitting operations including loose course knitting have been made by operating the carriage Y in the conventional manner and the knitting machine is just ready for knitting pattern stitches. The carriage Y is in a stationary state on the needle bed *x* at the left or right thereof outside a group of operative or working needles. Further, the left and right boundary members 3*l* and 3*r* are put in desired positions on the needle bed *x*, respectively.

Under these conditions, first of all, the operator manually sets in the feeding means the pattern program card 1 on which necessary informations and patterns have been drawn or inked in. By manually rotating the ratchet wheel 14 counterclockwise, the card 1 is forwarded until the lateral center line of the instruction mark 36, that is line $P_1$—$P_1$ on the card shown in FIG. 12, reaches a position located substantially opposite to the scanning sensor *c* of the scanner *b* in the starting position.

Thereafter, the operator turns on a power switch (not shown) and pushes predetermined buttons arranged on the control panel 2 and then a start button CB. An electric circuit associated with these switches will be explained hereinafter. Necessary instructions are sent so that the driving mechanism *a* and the scanner *b* automatically perform predetermined operations in a predetermined order. As a result, the relevant circuit is ready for the operation to select the needles which are required for the carriage Y to knit the first row of the pattern. The subsequent operations of the program providing system are as follows;

1. The card 1 is fed by an increment in either direction.
2. The scanner *b* moves to the right, reverses its moving direction and returns to its starting position. In accordance with this reciprocal movement, the sensor *c* scans the unit number region 1*s* and reads the information in the form of an inked square, and hence, the unit number of needles to be selected is set or stored in the relevant circuit (memory).
3. The card 1 is fed forwardly until the sensor *c* can scan and read the control mark 34 in the first row.
4. The scanner *b* reciprocates again. In accordance with this, the sensor *c* scans the first row sections in the knitting pattern region 1*p* and the function mark region 1*f* and hence, signals including informations concerning the needles selected during the knitting of the first row are sent and stored in an erasable temporary storage or memory in the relevant circuit.

Next, the conventional operations necessary prior to the pattern knitting are to be performed. For example, a desired combination yarn is threaded into a known combination yarn-feeder as a second yarn feeder fixed to the carriage Y. Thereafter, the operator can traverse the carriage Y along the needle bed *x* including the operative needles beyond the left and right boundary members 3*l* and 3*r*, in a reciprocating manner. In the left to right and right to left movement of the carriage Y, only when the needle selection performing point F' of working one of the needle selecting mechanisms F*l* and F*r* in the carriage Y is between the boundary members 3*l* and 3*r*, a needle selection signal which has been stored in the memory as described above is read out from the memory in a predetermined order each time the carriage Y is moved by a spacing between the two adjoining needles (see the above-described Patent Application). The thus derived signals are sent to working one of the needle selecting mechanisms F*l* and F*r*, which performs the instructed needle selection. On the other hand, when the carriage Y reaches the boundary member 3*l* or 3*r*, or a first one if plural pairs of boundary members are set on the needle bed, the driving mechanism *a* is actuated to move the card 1 forward by an increment of one row. As a result, the scanner *b* reads a new feed control mark 34 in the second row and starts to scan the second row in the regions 1*p* and 1*f* on the card 1 and the corresponding informations are stored in the memory. It is assumed that the memory used herein comprises two portions which can store and read informations independently so that storing in one and reading from the other, or vice verse, can be effected. These newly stored signals are to be read when the moving direction of the carriage Y is reversed and the carriage is moved in the opposite direction.

It is obvious that the subsequent operations are carried out in a similar manner as described above. Accordingly, each time the carriage Y is traversed to the left or the right, the corresponding storing and reading of informations are effected in the memory and as a result, the needle selection and hence the pattern knitting according to the informations involved in the card 1 are carried out in the range between the left and right boundary members 3*l* and 3*r*.

The above-described information processing required to apply the informations in the knitting program card 1 to the effective needles is handled by a single control circuit, which will be described hereinafter.

Figure 10:
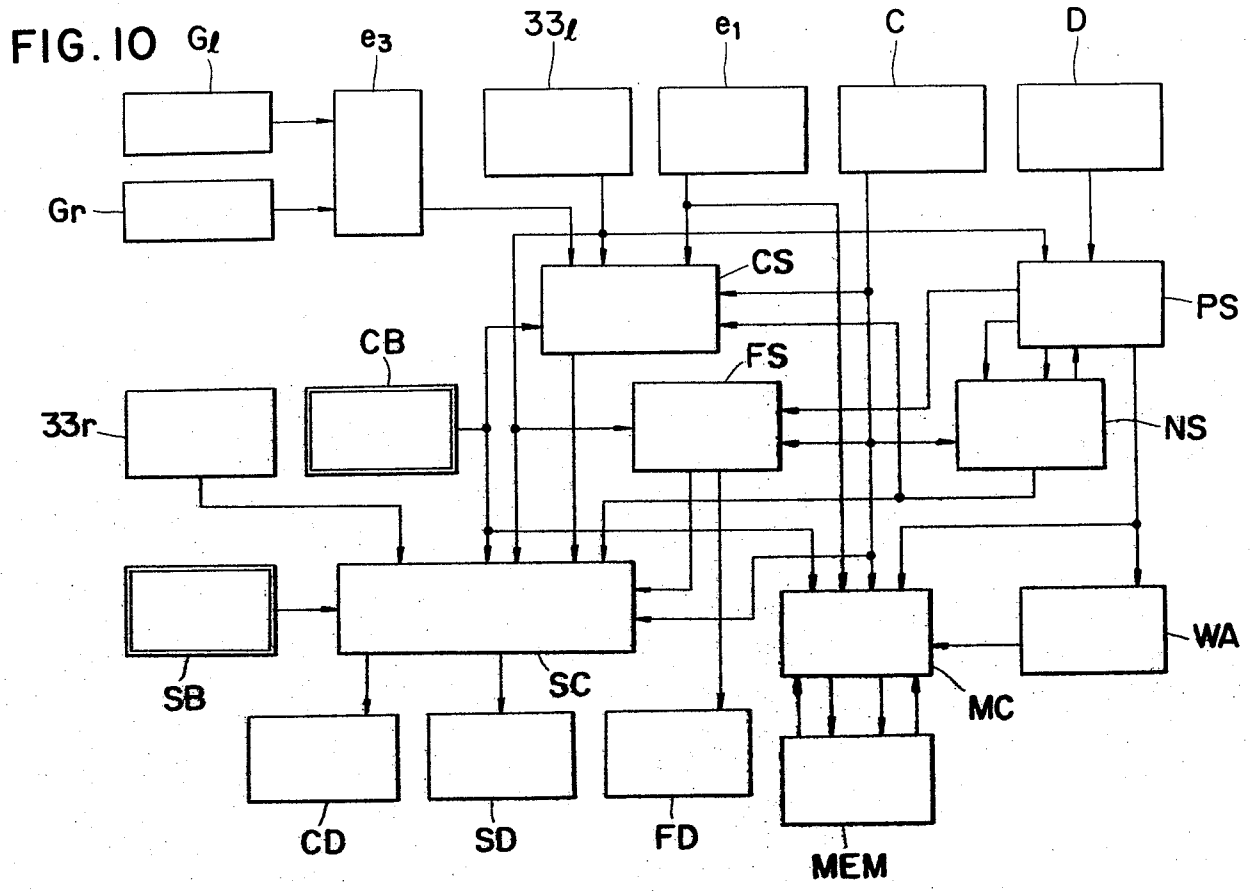
FIG. 10 is a block diagram illustrating an input function part of a control means for processing data resulting from the scanning of the program card and storing the data in a memory.
Figure 16:
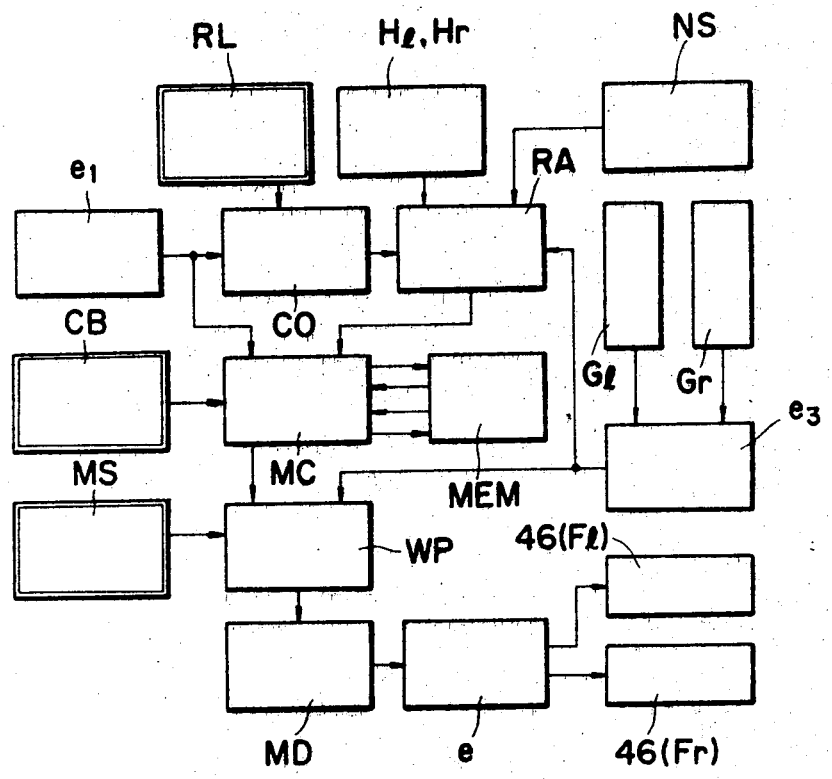
FIG. 16 is a block diagram illustrating an output function part of the control means for reading the stored data and sending needle selection signals.

To meet the convenience of illustration, the control circuit is divided into two, ie., an input function part and an output function part, which are illustrated as in the form of a block diagram in FIGS. 10 and 16, respectively.

FIG. 10 diagrammatically shows the input function part of the control circuit which comprises an information processing part for reading informations involved in the card 1 and storing them in a memory MEM and a control part which can control the feeding of the card 1 and the movement of the scanner *b* (which operations are both necessary to perform the above reading operation) because this control part is controlled or influenced by the feeding of the card, the scanning of the scanner and the read informations. FIG. 16 diagrammatically shows the output function part of the control circuit which has an information processing function for reading the signals stored in the memory and applying them to the associated needles to actually select needles.

As shown in FIG. 10, the information processing part of the input function part comprises an effective scanning data forming circuit C for deriving read signals of the scanning sensor *c* and the sampling sensor *d* as effective only when the scanner *b* is in the forward (moving to the right in FIG. 2) state including the starting point; an effective sampling pulse forming circuit D; a separation circuit PS for separating output pulses from said circuit D according to their application (refer to the description concerning the slits 38*s*, 38*p* and 38*f* of the linear encoder 37); a circuit NS for setting the unit number of needles to be selected in response to the instruction mark 36 and a mark representing the unit number in the region 1*s* on the card 1; a circuit WA for addressing the memory MEM during writing output data of said data forming circuit C; a control circuit MC for controlling the writing and reading of the memory MEM; and a discriminator FS for discriminating function marks inked in the region 1*f* according to their function.

The control part of the input function part comprises an instruction circuit CS for instructing the commencement of the feeding and/or the subsequent scanning of the card; a control circuit SC for controlling so as to perform the feed and/or scan in a predetermined order according to different conditions at a given instant after said commencement instruction is made; and drivers CD and SD adapted to be controlled by said control circuit SC for exciting the electromagnet 16 (or 16') and the coil 31 to perform the feeding and scanning, respectively.

Another driver FD for actuating a buzzer is added to the input function part in FIG. 10.

The above-described input function part is operated as follows.

Figure 11:
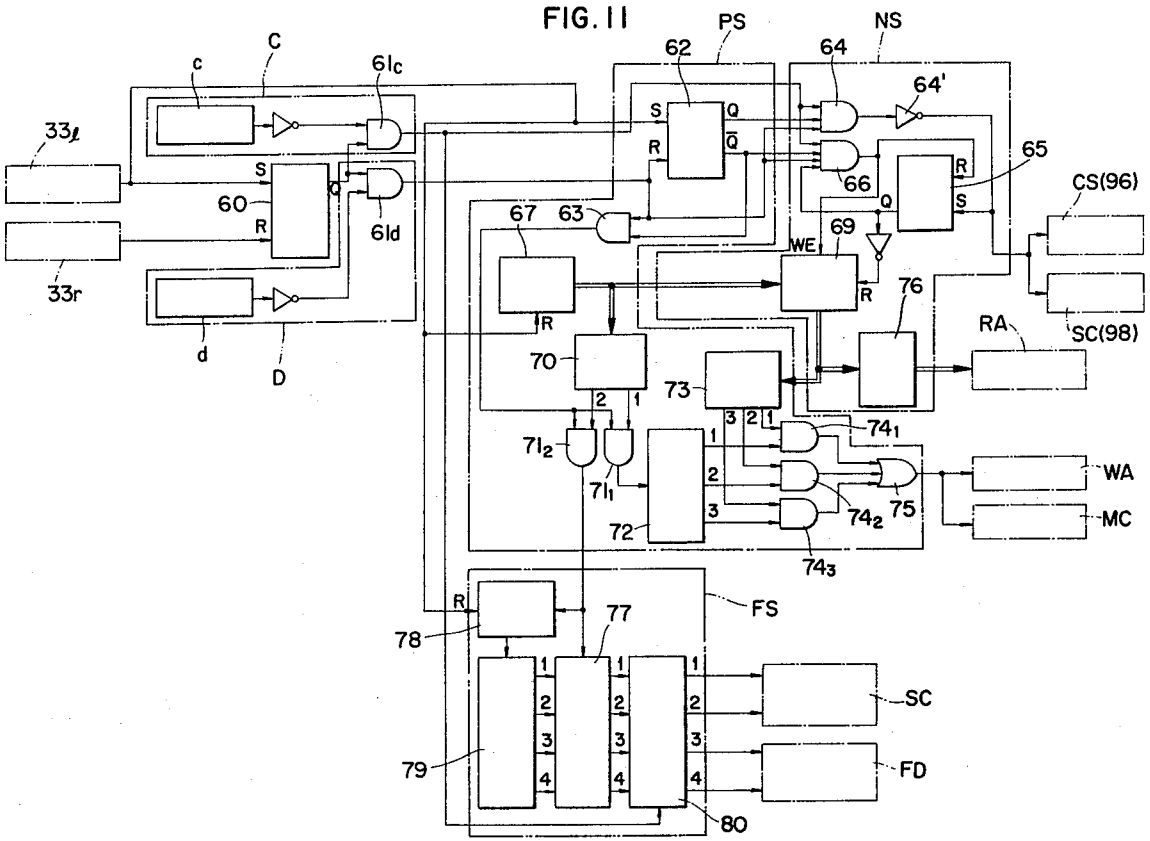
FIG. 11 is a circuit configuration illustrating an information processing part of the input function part of FIG. 10, including an effective scanning data forming circuit, an effective sampling pulse forming circuit, a pulse separation circuit, a unit number setting circuit, and a function discriminator circuit.
Figure 12:
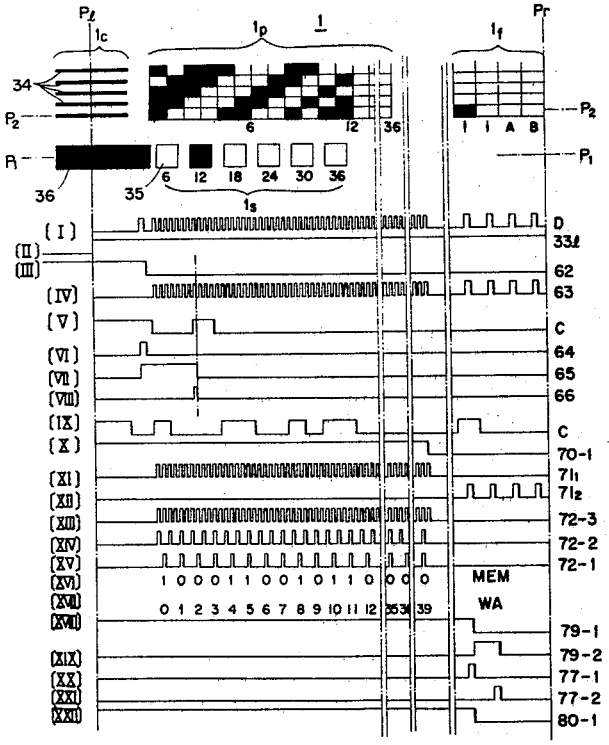
FIG. 12 is a time chart illustrating operations of the respective components of FIG. 11, in connection with information marks on the program carrier.

As apparent from FIG. 10, the information processing part has influence upon the control part of the input function part and accordingly, the feeding and scanning are controlled in terms of the results obtained by reading the card 1. In light of this fact, the information processing part is first explained. Reference is also made to FIGS. 11 and 12.

As shown in the block diagram of FIG. 11, the effective scanning data forming circuit C and the effective sampling pulse forming circuit D have a similar construction and comprise the scanning sensor *c* and the sampling sensor *d*, gates 61*c* and 61*d* connected to the respective sensors, and a common flip flop 60 connected to limit switches 33*l* and 33*r* for controlling said gates 61*c* and 61*d*, respectively. The output of the gate 61*d* is connected to gates 63 and 64 of the separation circuit PS which separates output pulses of the gate 61*d* into two groups of pulses. One group contains a first pulse associated with the slit 38*s* of the linear encoder 37, while the other group contains 124 pulses consisting of 120 successive pulses associated with the slits 38*p* and further four successive pulses associated with the slits 38*f* of the linear encoder 37. The outputs of the switches 33*l* and 33*r* and the gate 61*d* are connected to a flip-flop 62, the outputs of which are in turn connected to said gates 63 and 64 to control the latter. The above-described 124 pulses which have passed the gate 63 proceed to gates $\mathbf{71}_1$ and $\mathbf{71}_2$ where they are separated into two groups containing 120 and four pulses, respectively. In order to control the gates $\mathbf{71}_1$ and $\mathbf{71}_2$, a counter 67 for counting output pulses of the gate 63 and a gate network 70 for discriminating whether the counted value of the counter 67 is less than 120 or not are connected to the outputs of the gates $\mathbf{71}_1$ and $\mathbf{71}_2$.

Output pulses of said gate $\mathbf{71}_1$ are appropriately processed by suitable means (to be explained hereinafter) and sent to the memory control circuit MC and the writing address instruction circuit WA in order to sample outputs of the effective scanning data forming circuit C and store the sampled data in the memory. On the other hand, output pulses of the gate $\mathbf{71}_2$ are sent to the function discriminator FS.

In the foregoing explanation concerning the separation circuit PS, the gate 64 is described as a gate for taking out the first output pulse from output pulses of the gate 61*d*. In practice, the gate 64 also receives output signals of the effective scanning data forming circuit C and thereby detects the instruction mark 36 on the card 1. This means that the gate 64 also constitutes a part of the unit number setting circuit NS. This circuit NS comprises, in addition to the gate 64; a gate 66 adapted to sample outputs of the effective scanning data forming circuit C in terms of the output pulses of the effective sampling data forming circuit D except the first pulse and as a result, to detect a mark representing the unit number in the region 1*s*; a flip-flop 65 connected to said gates 64 and 66; a memory 69 connected to said gate 66 and the counter 67; and a code converter 76 connected to said memory 69.

The circuit NS having the above-described components serves to set the unit number of needles to be selected. This operation will be explained herein by referring to the reading of the card 1 along the line $P_1$—$P_1$ of FIG. 12 by the scanning sensor *c*. While scanning the card along the line $P_1$—$P_1$, first the gate 64 detects the instruction mark 36 as shown in FIG. 12 [VI] and sets the flip-flop 65. Subsequently, the gate 66 detects a mark representing the unit number in the region 1*s* as shown in FIG. 12 [VIII] and resets the flip-flop 65. Electrical connections are so made that the output of the flip-flop 65 is fed back to the gate 66 as a further input in order to effect the latter detection only at a necessary instant, that is, according to the instruction mark 36. At the same time, the counter 67 counts output pulses of the gate 63. The value of the counter 67 which is counted at the time of the latter detection is written in and stored in the memory 69. Hereafter, this value stored in the memory 69 substantially represents the set unit number.

In this example, the unit number of needles to be selected is chosen among multiples of "6", ie., 6, 12 . . . and 36, as shown in FIG. 12. In accordance with this the counter 67 comprises a seximmal counter part which counts pulses from the gate 63 and a 5-bit binary counter part which counts the obtained values of the former. The output of the latter counter part is, of course, the output of the counter 67. Therefore, the counter 67 counts by 6's and produces the corresponding output. The output of the counter will be 1, 2, 3 . . . or 6 (represented in the decimal code), when the number of the input pulses is 1–6, 7–12, 13–18 . . . or 31–36. The unit number of needles which is set according to the above output will be a product of the output by 6, i.e., 6, 12, 18 . . . or 36.

In light of the above regulation, since the number of input pulses to the counter 67 is 8 in this example as shown in FIG. 12 [IV], a value of "2" ($2 \times 6 = 12$) is stored in the memory 69. In this manner, the unit number of needles has been set and stored. This stored value is then converted to a binary value by the code converter 76 and offered to the reading address instruction circuit RA as the actual set unit number.

The counter 67 receives more than 120 pulses and can count them as described in the foregoing. Therefore, the unit number may be increased by 6 to 42, 48 . . . and 120. Accordingly, in addition to the card (first card) shown in FIG. 2 in which the number of columns of sections in the knitting pattern region 1*p* is 36 and the unit number may be set to 6–36, a second card shown in FIG. 18 in which the number of columns in the region 1*p* is 60 and the unit number may be set to 42–60 and a third card shown in FIG. 19 in which the number of columns in the region 1*p* is 120 and the unit number may be set to 66–120, may also be used in the program-providing system according to the invention. Depending on a desired unit number of needles to be selected, any one of the above three cards may be used in the system.

Figure 19:
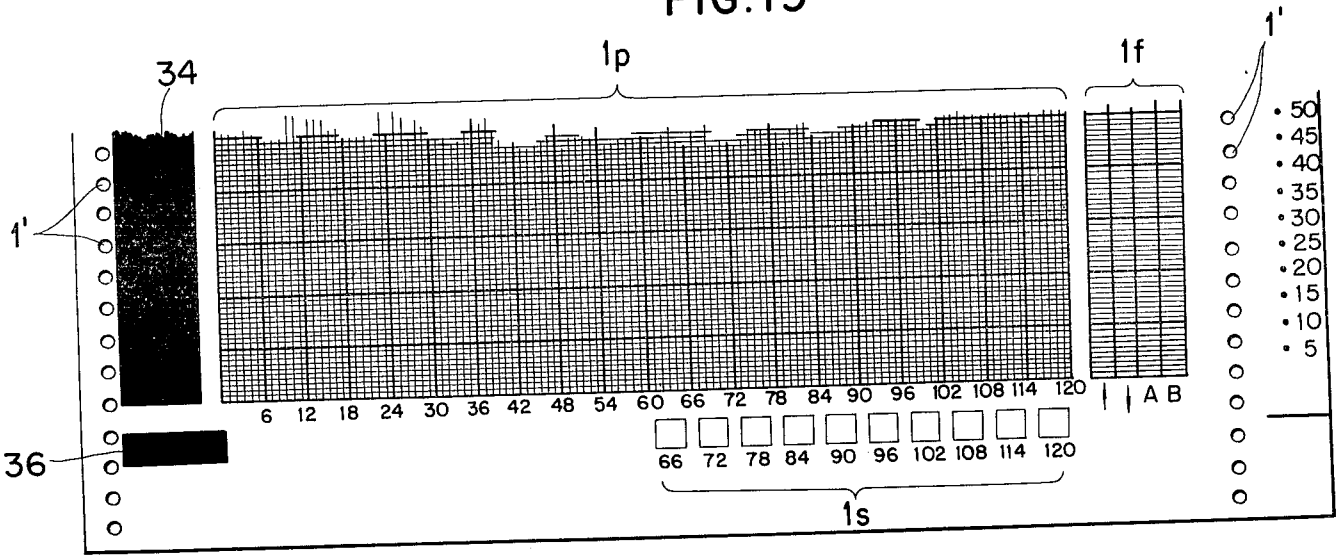

These three cards are so related that the dimensions of a unit section in the knitting pattern region 1*p*, that is, the width in the lateral direction (the direction of the scanning line $P_1$—$P_1$) and the length in the vertical direction of a unit section of the first and second cards (FIGS. 2 and 18) are 3 and 2 times larger than those of the third card (FIG. 19). Further, the spacing between the two adjoining knitting pattern sampling slits 38*p* in the linear encoder 37 and the increment of the feed of the ratchet wheel 14 are equal to the width and length of the unit section of the third card. Accordingly, the respective sections of the first, second and third cards correspond to 3, 2 and 1 slit 38*p*. The respective sections also correspond to 3, 2 and 1 time excitation of the electromagnet 16 (or 16').

Under these conditions, however, sections should be read one by one as independent sections each representing one information. To this end, the separating circuit PS is provided with means for discriminating which card is used among the three and based on the result of this discrimination, producing sampling pulses each corresponding to one section of the relevant card.

The pulse selection circuit 72 connected to the gate $71_1$ can produce the three pulse groups which have been processed so as to match with the three cards, respectively. That is, the pulse selection circuit 72 is so designed that its output 72-3 may pass the above-described 120 pulses in an intact manner for the third card, as shown in FIG. 12 [XIII]. Its output 72-2 may pass 60 pulses left after eliminating the even-numbered pulses from the 120 pulses for the second card, as shown in FIG. 12 [XIV]. Its output 72-1 may pass 40 pulses left after eliminating the $3n$th and $(3n - 2)$th pulses from the 120 pulses for the first card ($n$ is a positive integer), as shown in FIG. 12 [XV]. Such a circuit 72 may be composed of counters and gates. The pulse selection circuit 72 is connected to gates $74_1$, $74_2$ and $74_3$ in order to selectively use the outputs 72-1, 72-2 and 72-3.

On the other hand, the memory 69 of the unit number setting circuit NS is connected to a gate network 73 for determining which group among the (6–36), (42–60), and (66–120) groups the set unit number belongs to, in other words, discriminating which card is used among the three. This gate network 73 selectively opens one of the gates $74_1$, $74_2$ and $74_3$ according to the result of this discrimination. In this manner, pulses matched with the card used appear as the output of the circuit PS at the output of the gate 75 connected to the gates $74_1$, $74_2$ and $74_3$. It is obvious that the feeding amount of the card 1 at one time, ie., the number of excitation of the electromagnet 16 (or 16') may be controlled by using the output of the gate network 73, and not using the feed control mark 34 on the card.

Still remaining among the components of the information processing part shown in FIG. 11 is the function discriminator FS. The output of the gate $71_2$ is connected to the discriminator FS which comprises a well-known combination of a counter 78, a decoder 79 and a gate group 77. The above-described 4 pulses coming from the gate $71_2$ are separated from each other in the discriminator FS and then successively forwarded from the outputs 77-1 to 77-4 of the gate group 77, as shown in FIG. 12 [XX] and [XXI].

The four pulses discriminated by the gate group 77 are sent to a function storage circuit 80 which comprises D-type flip-flops and other components. In this circuit 80, the output (FIG. 12 [IX]) coming from the effective scanning data forming circuit C is subjected to sampling for each section (column) in the function mark region 1*f*. The sampled data are independently stored for each column as shown in FIG. 12 [XXII]. The storage circuit 80 has four outputs 80-1 to 80-4. Signals appearing at the outputs 80-1 and 80-2 are sent to the input of the controlling circuit SC for controlling the feeding and scanning of the card 1. The signal from the output 80-1 functions to feed the card forward and the signal from the output 80-2 functions to feed the card backward. Further, signals from the outputs 80-3 and 80-4 are sent to the input of the function driver FD to achieve other functions such as the actuation of a buzzer.

The information processing part having the above-described configuration also serves to read the knitting pattern and function mark regions 1*p* and 1*f* on the card 1. This operation will be explained below, referring to the reading of informations by the scanning sensor *c* along the line $P_2$—$P_2$ in FIG. 1.

First of all, the sensor *c* reads the feed control mark 34 (FIG. 12 [IX]). However, the reading of this mark causes no operation, due to the absence of a sampling pulse. Next, though the first pulse (above-mentioned) is applied, the sensor *c* reads that there is no mark. Accordingly, the above-mentioned operation to set the unit number of needles to be selected is not initiated. Thereafter, the sensor *c* reads information in the knitting pattern region 1*p*. These data are sampled according to the sampling pulses matched with the card used, in this case, the sampling pulses shown in FIG. 12 [XV]. The sampled data are stored in addressed portions of the memory MFM according to the address instruction by the writing address instruction circuit WA as shown in FIG. 12 [XVI] and [XVII]. Finally, the sensor *c* reads informations in the function mark region 1*f*. Since the leftmost section in the function mark region 1*f* on the card 1 has been marked in this case, the sensor *c* scanning along the line $P_2$—$P_2$ reads this information of the first column. This signal executes the predetermined function to set the feeding direction of the card 1 to the forward. In connection with this operation, it is to be noted that the feeding direction of the card has been determined to be forward during the preceding scanning along the line $P_1$—$P_1$, which will be described hereinafter. However, the above mark in the region 1*f* can be used to reverse the feeding direction when the card has been fed backward. This means that the function mark representing forward feeding can be used to obtain a vertical mirror repeat of the pattern.

The other part of the input function part, that is, the control part will be described below, referring to FIG. 13.

As described in the foregoing, the control part comprises the instruction circuit CS, the control circuit SC and the drivers CD and SD. The feed/scan instruction circuit CS is designed so that the feed/scan start instruction may be ordered in three different states. The feed/-scan instruction circuit CS comprises: (1) an inverter 81 connected to the start button CB, so that the instruction circuit may respond to the pressing of the button CB; (2) a gate 99 connected to the effective scanning data forming circuit C and the left limit switch 33*l* and a flip-flop 96 connected to the gate 64 of the unit number setting circuit NS and said gate 99, so that the instruction circuit may respond to the setting of the unit number of needles to be selected; and (3) a carriage reversal detecting circuit 100 connected to the switch part $e_1$ for detecting the moving direction of the carriage, a flip-flop 101 connected to said circuit 100 and a gate 102 connected to the switch part $e_3$ for instructing the effective needle selection range and said flip-flop 101, so that the instruction circuit may respond to the arrival of the carriage Y at a first boundary member 3*l* (or 3*r*) after the moving direction of the carriage is reversed. The instruction circuit CS further comprises an OR gate 82 connected to the inverter 81, the flip-flop 96 and the gate 102 and another inverter 82' connected to said gate 82. The output of the inverter 82' is sent to the control circuit SC as the start instruction from the instruction circuit CS and at the same time, is applied to the flip-flop 101 to reset the latter.

The control circuit SC essentially comprises a first part for controlling the feed driver CD and a second part for controlling the scan driver SD. The first part consists of a flip-flop 83 for storing the instruction from the instruction circuit CS; a pulse generator 87 for generating feed pulses; a circuit having flip-flops 89 and 91 and a pair of exclusive OR gates 90 for determining the feeding direction; a control circuit 86 for supplying the feed pulses of said pulse generator 87 from the output 86-1 or 86-2 connected to the feed driver CD, the feed pulses being controlled in terms of the setting of the flip-flop 83, the output condition (ON or OFF) of the left limit switch 33*l* and the output condition of the feeding direction determining circuit; and a flip-flop 88 for resetting said flip-flop 83. The second part consists of a flip-flop 84 for storing the instruction from the instruction circuit CS and sending an instruction of the forward movement of the scanner *b;* a flip-flop 94 connected to the right limit switch 33*r* for sending an instruction of the backward movement of the scanner *b;* and a delay circuit 95 connected between the left limit switch 33*l* and said flip-flop 94 for cancelling the instruction of said flip-flop 94 after the scanner *b* has returned to its starting position and resumed the substantially stationary condition. The control circuit SC further comprises a gate 92 which is connected between the flip-flop 84 and the scan driver SD and is also connected to the flip-flop 83. This gate 92 serves to initiate the scanning in a correct order after the completion of feeding.

Figure 13:
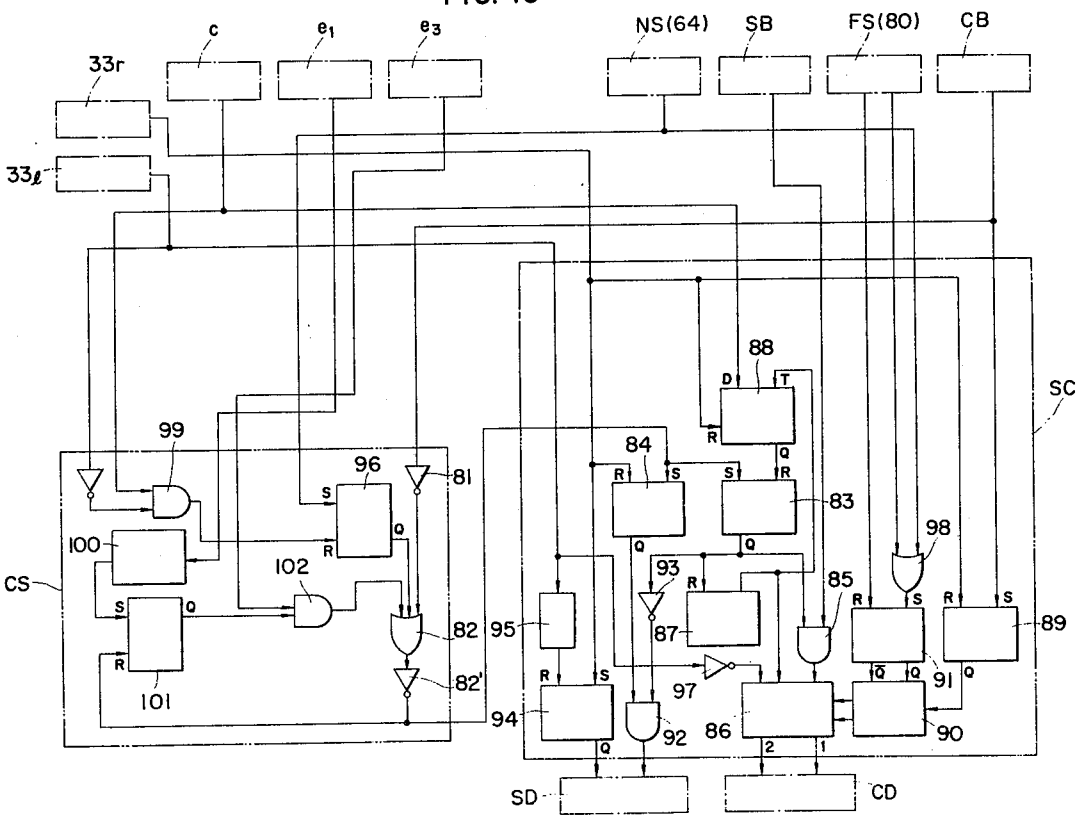
FIG. 13 is a circuit configuration illustrating a control part of the input function part of FIG. 10, including an instruction circuit and a control circuit.

The control part shown in FIG. 13 has the above-described configuration. In a similar manner to the above, the operation of this control part will be explained with respect to the operation to perform the feeding and scanning in response to the movement of the carriage Y, by referring to FIG. 15.

In response to the movement of the carriage Y, the circuit portion used in case (3) described above in relation to the instruction circuit CS is operated. The instruction circuit CS supplies a feed/scan start instruction to the control circuit SC as shown in FIG. 15 [V]. As a result, the flip-flops 83 and 84 are set and thus the pulse generator 87 is actuated. The actuated generator 87 first produces a pulse which is transmitted to the control circuit 86, which in turn supplies said pulse to the feeding driver CD from its outputs 86-1 or 86-2 associated with the direction determined by said feeding direction determining circuit. In accordance with this output, the card 1 is fed by an increment in a selected or predetermined direction. An operation following this feeding is dependent upon the result from the reading of the scanning sensor *c* at the end of said feeding. The flip-flop 88 samples the output of the effective scanning data forming circuit C and stores the sampled output in response to the fall of said pulse. In this sampling, if the sensor *c* does not read a control mark 34, the content of the flip-flop 83 is maintained. Accordingly, the pulse of the pulse generator 87 provides another feed of the card by a further increment. This feeding operation is continued until the sensor *c* reads a control mark 34 during said sampling. As a result, the flip-flop 83 is reset. In FIG. 15, the first card shown in FIG. 12 is used. Therefore, one feeding consists of 3 increments as shown FIG. 15 [VIII].

The resetting of the flip-flop 83 opens the gate 92, which permits the flip-flop 84 to supply the instruction for forward movement of the scanner *b* to the scanner driver SD. Accordingly, the scanner *b* starts moving forward and then reaches the right stroke end to turn on the limit switch 33*r*. The switching of the limit switch 33*r* resets the flip-flop 84 and at the same time, the flip-flop 94. The latter flip-flop 94 produces the instruction for backward movement. The scanner *b* thus starts moving backward. Even after the scanner *b* reaches the left stroke end to turn on the limit switch 33*l* (FIG. 15 [X]), this backward movement instruction of the flip-flop 94 is continued for a predetermined period of time due to the delay circuit 95, and is then cancelled (FIG. 15 [XVI] and [XVII]). Said delay circuit 95 serves to prevent the incomplete return of the scanner *b* to the starting position because of a rebound. At this time, the control circuit SC resumes its original state and is ready for the next start instruction given by the instruction circuit CS.

In the above-described operation, the start button CB may be pressed when it is desired to start the pattern knitting. The operation of the circuit resulting from this pressing of the button will be explained below with reference to FIG. 14.

Figure 14:
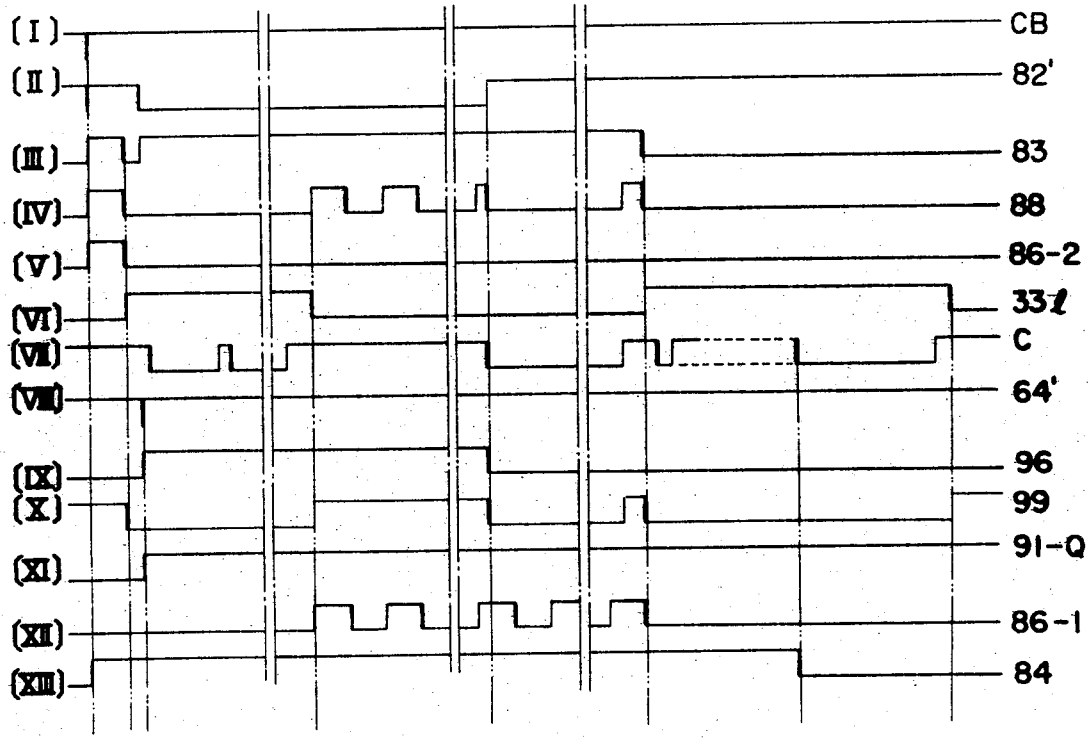
FIGS. 14 and 15 are time charts illustrating operations of the respective components of FIG. 13.

Upon pressing the start button CB, the flip-flop 89 is set and the instruction circuit CS produces a feed/scan start instruction (FIG. 14 [II]). The start instruction permits the control circuit SC to operate in the above-described manner, so that the card 1 is fed by an increment. The moving direction of the card 1 is opposite to the direction instructed by the flip-flop 91 because the flip-flop 89 is set, but is forward because the instruction direction of the flip-flop 91 has been reversed. A flip-flop which is resetable when the power switch is turned ON is used as the flip-flop 91. Since the scanning sensor *c* reads the instruction mark 36 at the end of the feeding of the card 1, the feeding operation is continued no longer. Immediately, the scanner *b* reciprocates in the same manner as above. As a result of this reading by the scanner along the line $P_1$—$P_1$ in FIG. 12, the unit number of needles to be selected is set. During the reading, the gate 64 (FIG. 11) produces a signal representing the detection of the mark 36 (FIG. 14 [VIII]). This signal sets not only the flip-flop 91 of the control circuit SC to change the instruction direction thereof to the forward, but also the flip-flop 96 of the instruction circuit CS to cause the circuit portion of the instruction circuit SC used in case (2) to operate. The output of the set flip-flop 96 is again given from the instruction circuit CS to the control circuit SC as said feed/scan start instruction. As a result, the control circuit SC is actuated again and the card 1 is fed by an increment. The feeding direction is forward in this case because the flip-flop 91 is set and the flip-flop 89 is reset when the right limit switch 33*r* is turned on during the reciprocation of the scanner *b*. At the end of this feeding, the circuit 88 produces an instruction to reset the flip-flop 83 as a result of the reading of the mark 36 by the sensor *c* as described above. However, irrespective of this instruction, the setting of the flip-flop 83 based on the start instruction coming from the flip-flop 96 is maintained because the flip-flop 83 is so constructed that the setting signal is preferential in this case. Therefore, irrespective of the detection of the mark 36 by the sensor *c*, the card 1 is successively fed forward. The sensor *c* deviates from the area of the mark 36 at last. The flip-flop 96 is reset and the start instruction is cancelled at this time. However, the card 1 is further fed forward because the reset instruction coming from the circuit 88 is also cancelled. This feeding operation is also cancelled. This feeding operation is continued until the sensor *c* detects the control mark 34 in the first row, as obvious from the above-described circuit operation. In the subsequent step, one reciprocation of the scanner *b* is made again. A series of operations resulting from the pressing of the start button CB are completed in this manner.

The start button CB is used as input means to start pattern knitting in relation to the mark 36 on the card 1 as described above. In addition, the start button CB may be used as a correction button when incorrect knitting should be corrected. For example, incorrect knitting requires the loosening of a certain number of rows (courses) of an incorrectly knitted portion and then the correct knitting of these same rows. In this case, it is also necessary to return the card 1 by the same number of rows and start scanning again from this replaced position. The necessary operation may be simplified by using the start button CB. That is, the pressing of the start button CB leads to the opposite or backward movement of the card 1. Accurately, the card 1 is fed in the backward direction by an increment each time the button is pressed. The same number of pressings can bring the card 1 back to the required position. Scanning is carried out in this condition. Therefore, the machine is ready for pattern knitting a first row of correction after the same number of pressings.

Th above-described input function part further comprises additional, manually operable input means of stop button SB. This button is also mounted on the control panel 2 and connected to the input of the gate 85 (FIG. 13). When the button SB is pressed, the gate 85 is closed so that the output of the set flip-flop 83 is cut off from the control circuit 86. As a result, the feeding of the card 1 is stopped. If the instruction circuit CS gives a start instruction to the control circuit SC under the condition that the button SB is effective, the flip-flop 83 is set. While the feeding operation is not carried out due to the above cut-off, the pulse generator 87 is actuated. Thus, the flip-flop 83 is reset at a rise edge of a first output pulse, since the scanning sensor *c* remains opposite to the same control mark 34. Subsequently, the scanner *b* moves. In summary, the card 1 is repeatedly scanned for the same row in response to the movement of the carriage Y when the stop button SB is being pressed. As a result, the relevant row in a given knitting pattern is repeatedly reproduced as successive, identical courses.

As explained in the foregoing, a bi-directional step motor may be used instead of the combination of electromagnets 16 and 16'. In this case, the control circuit SC (FIG. 13) is modified as follows: In order to supply a signal to instruct the rotation direction of the motor and a pulse to drive the motor to a driver circuit for driving the motor, the output of the circuit 90 is directly connected to said driver circuit and the control circuit 86 to be connected to said driver circuit is composed of a 3-input AND gate.

Next, the output function part will be described with reference to FIG. 16. The configuration of this part is similar to that disclosed in the above-described Patent Application.

A circuit RA has a function of addressing required when data stored in the memory MEM are to be read. The addressing circuit RA including an up-down counter is connected to the switch $e_3$ for instructing the effective needle selection range, the timing pulse generators H*l* and H*r*, the unit number setting circuit NS of the above-described input function part and a comparator CO, so that only when the carriage Y is positioned between the boundary members 3*l* and 3*r* or within the effective needle selection range, the addressing circuit RA may count interval pulses associated with the movement of the carriage Y in an additive or substractive manner up to a limit having a predetermined value. The comparator CO is connected to manually operable input means RL for determining the relation of the moving direction of the carriage Y to the addition-substraction direction in the counter of said circuit RA and as a result, determining whether a pattern to be formed on the resulting knitted fabric should be identical or inversely symmetrical with the knitting pattern on the card 1 in the lateral direction, and the switch $e_1$ for detecting the actual moving direction of the carriage Y. This comparator CO compares the output of the same RL with that of the switch part $e_1$ to select alternatively the addition or subtraction in said counter. The output of the switch part $e_1$ representing the moving direction of the carriage Y is sent to the memory control circuit MC to control the writing and reading in the above two memory parts of the memory MEM. The memory control circuit MC supplies the data read from the memory MEM to a shaping circuit WP. The shaping circuit WP is connected to the said switch part $e_3$ so that one of the electromagnets 46 can be excited only when the carriage Y is present between the boundary members 3*l* and 3*r*, and also is connected to manually operable input means or mode selecting means MS so that the data read from the memory MEM and hence a pattern to be formed on the resulting knitted fabric can be reversed (color reversal). The output of the shaping circuit WP is amplified by an electromagnet driver MD and then supplied to the electromagnet 46 of working one of the needle selection mechanism F*l* and F*r* (which is effective with respect to the moving direction of the carriage Y) through the switch part $e_2$. Needle selection is performed in response to the excitation of the electromagnet 46.

The correct button CB which is described with reference to the input function part is connected to the memory control circuit MC so that the data which are read from the knitting pattern informations (1*p*) on the card 1 upon pressing the button CB, may be stored in the above two memory parts of the memory MEM.

A second embodiment of the program providing system according to the invention will now be described referring to FIGS. 20 to 22.

If the program providing system A is not covered, the ambient light will enter the program providing system, particularly a space where the scanning sensor *c* and sampling sensor *d* of the scanner *b* are mounted, especially a space between the scanning sensor *c* and the surface portion of the card 1 to be scanned. This troublesome light has the influence on the sensors so that the sensors are likely to misread. To prevent the occurrence of such a misreading, a special precaution is taken for the present situation. That is, the control panel 2 is mounted on the machine body X to cover the program providing system A.

Figure 20:
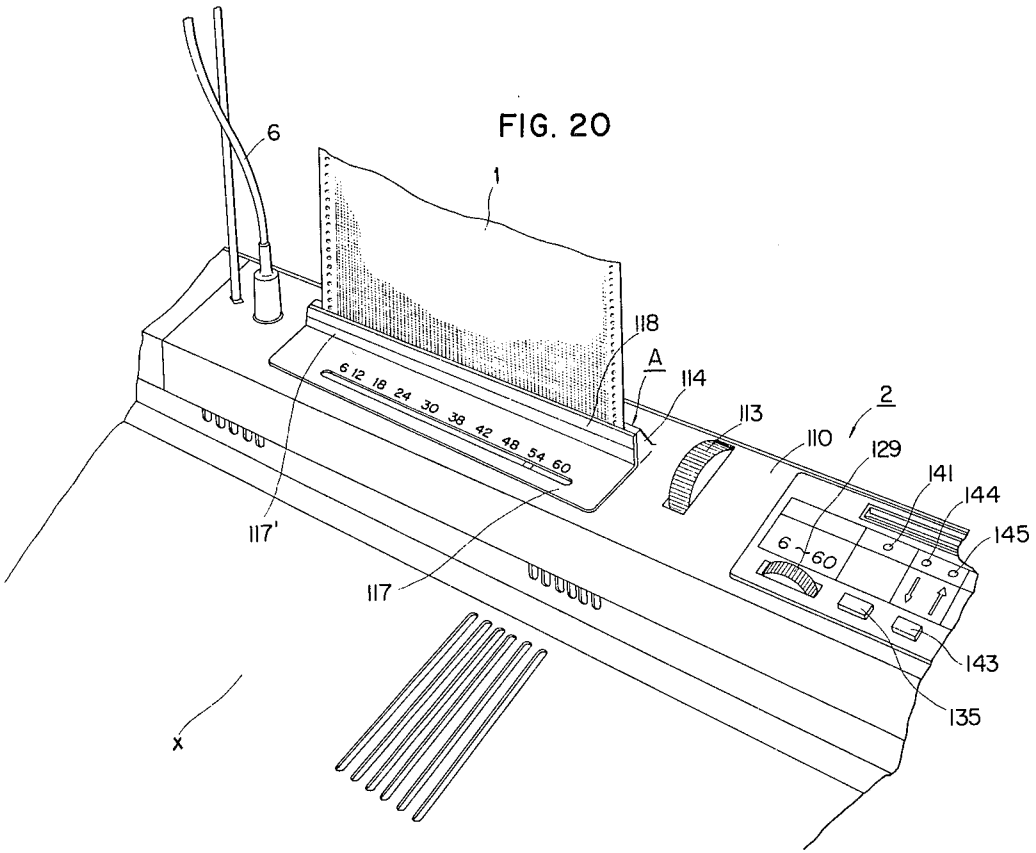
FIG. 20 is a schematic perspective view of a control panel according to a second embodiment of this invention.
Figure 21:
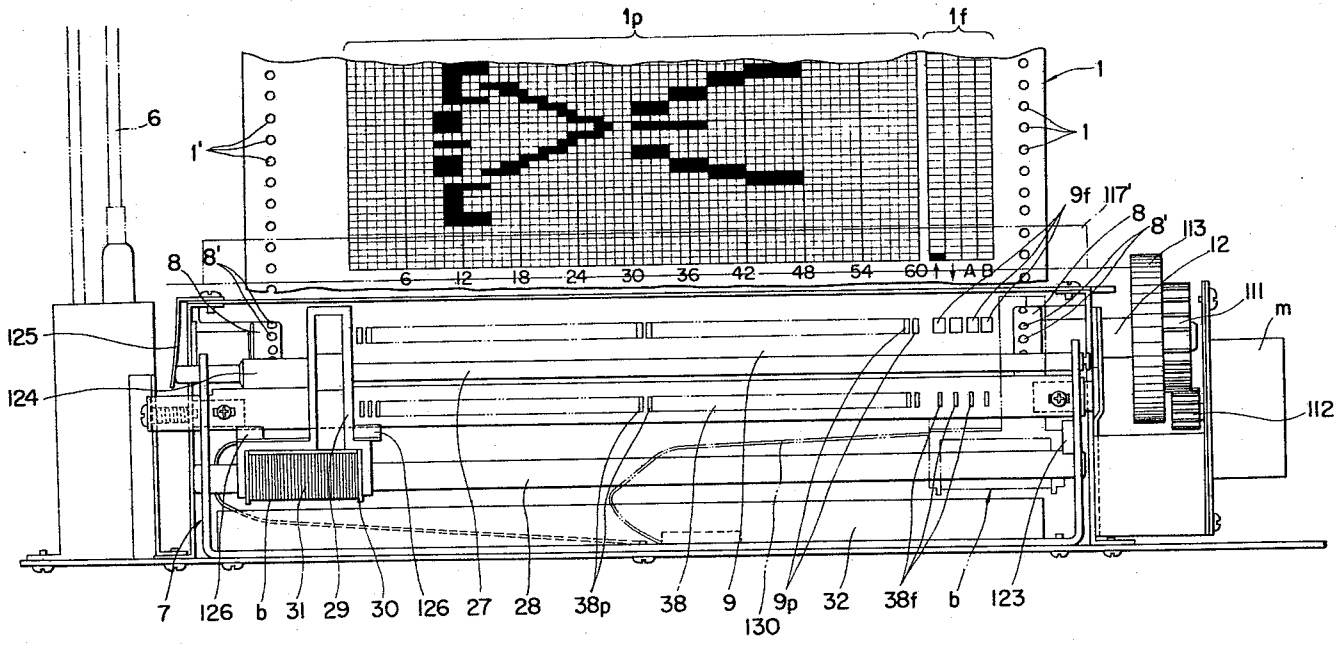
FIG. 21 is a front view, similar to FIG. 2, of a feeding device and a scanner according to the second embodiment.
Figure 22:
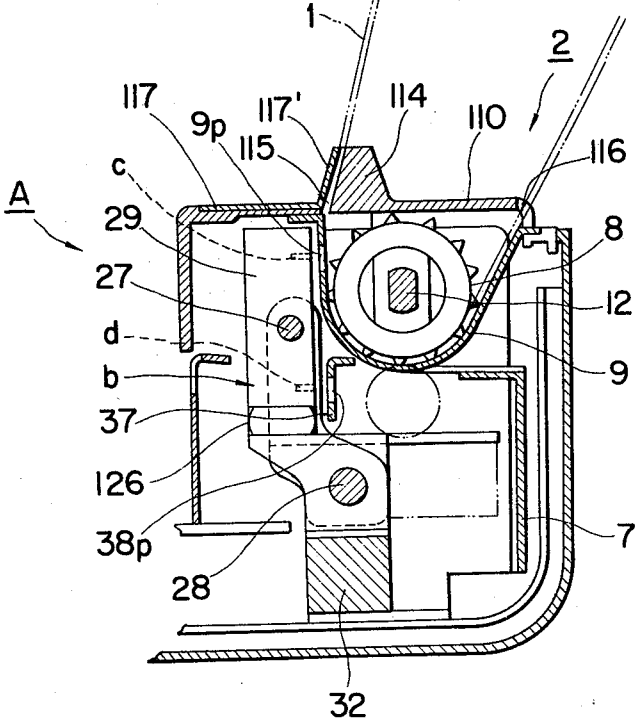
FIG. 22 is a vertical cross section of the feeding device and scanner of FIG. 21.

In the embodiment shown in FIGS. 20 to 22, the control panel 2 comprises a cover plate 110 which is mounted between the top of the rear wall of the frame 7 and the standing wall $x_3$. At the left of the cover plate 110 are longitudinally preformed a protruding portion 114 and an elongated slot 115. The cover plate 110 is also preformed with another elongated slot 116 which is an exit for the card. The width of the protruding portion 114 and slots 115 and 116 is somewhat larger than that of the card 1. In front of the slot 115, a transparent member 117 is placed on the cover plate 110. The transparent member 117 has an oblique rear portion 117' which forms a path with the front surface of the protruding portion 114. This path is communicated to the slot 115 to define an entrance through which the card 1 can be passed to the interior. The oblique rear portion 117' is marked with a reference line 118 which is used to align the card 1.

The card 1 used in the second embodiment is the same as in the first embodiment except that the control marks 34, instruction mark 36 and unit number region 1*s* are omitted. In addition to the knitting pattern region 1*p* and the function mark region 1*f*, the card further includes means for setting the unit number of needles to be selected in combination with a dial 129 on the control panel 2, which means is not shown in the drawings because it is not essentially related to the scope of the invention.

The feeding means has the following construction which must be regarded as identical with that of the first embodiment in an essential sense. Between left and right side walls 7' of a frame 7 is a shaft 12 rotatably supported and which is, in turn, fixed with a pair of sprocket wheels 8. The sprocket wheels 8 are provided with protrusions 8' which will be engaged with the perforations 1' of the card 1 when the card 1 is loaded and fed forward or backward. A guide plate 9 having a nearly U-shaped cross section (FIG. 22) is attached to the side walls 7', which plate guides the card 1 inserted from the entrance 115 to the outer periphery of the sprockets 8 and then to the exit 116. The front portion of the guide plate 9 is successively perforated with a plurality of slits 9*p* and 9*f* for exposing the informations on the card to the sensor *c* one by one, each slit corresponding to a section in the knitting pattern region 1*p* and function mark region 1*f*. In a similar manner, a linear encoder 37 is perforated with a plurality of slits 38*p* for sampling purpose.

As shown in FIG. 21, the shaft 12 is extended beyond the right side wall 7'. This extension is firmly provided with a gear 111 which is engaged with a gear 112, which is, in turn firmly fitted on a drive shaft of a bidirectional pulse or step motor *m*, whereby an incremental feeding operation of the card 1 is effected by a rotational stepping movement of the drive shaft of the step motor. The extension is also firmly provided with an adjusting wheel 113 adjacent the gear 111, the upper portion of which is exposed from a window formed in the cover plate 110 (see FIG. 20). An operator can turn the adjusting wheel by finger to feed the card 1.

A pair of parallel guide bars 27 and 28 are supported between the side walls 7'. On the guide bars 27 and 28 is slidably fitted a runner 29 which is a component of the scanner *b*. The scanner further comprises a bobbin 30 of ferromagnetic material on which a coil 31 is wound. The bobbin 30 encloses the lower guide bar 28 with a clearance. Further, a permanent magnet 32 which forms a linear motor with the coil 31 is placed below the lower guide bar 28 over the moving range of the runner 29.

The right side wall 7' is provided with a damping stopper 123 which defines the right stroke-end against the scanner *b*. On the other hand, a stopper 124 is firmly secured on the left end of the guide bar 27 which is mounted to the side walls 7' for sliding movement within a given distance. A plate spring 125 secured to the left side wall 7' is extended downwardly so as to abut with the end of the bar 27. Therefore, the stopper 124 defines the left stroke-end against the scanner *b*. When the scanner *b* runs backward (to the left), it will collide with the stopper 124. The impact is, however, dampened by the spring 125. Consequently, the reaction which otherwise will occur each time the scanner reaches the left stroke-end can be effectively prevented.

Further, it is preferable to reduce frictional force resulting from the inter-action between runner 29 and the guide bars 27 and 28. It is to be noted that the frictional force depends on the total weight of the scanner *b*. The runner 29 is provided with permanent magnet pieces 126 which are so oriented that the magnets 32 and 126 exert repulsive forces on each other. When the magnet 32 has a north pole at the top, the north pole of the magnets 126 is faced to the former. As a result, the runner 29 is always lifted vertically by the influence of bouyancy.

To establish the electrical connection between the coil 31 of the scanner *b* and a circuit built in the control box B, a flexible cord 130 is connected to the runner 29 at one end and to any desired position of the frame 7 at the other end. (The cord 130 is drawn in broken lines in FIG. 21) As the flexible cord 130, use may be made of a known flexible cord, for example, a sheet-like cord in which a plurality of parallel conductive strips are enveloped in an insulating material. Such a flexible cord can follow the reciprocal movement without any trouble.

The circuit configuration for controlling the above-described mechanism may be obtained by modifying the circuit configuration shown in FIG. 10. The following modifications should be made on the circuit configuration of FIG. 10.

1. The unit number setting circuit NS is eliminated.
2. In relation to (1), the pulse separation circuit PS and the feed/scan instruction circuit CS are modified.
3. The start button CB and the feed/scan control circuit SC associated therewith are modified.
4. The last-mentioned control circuit SC is modified so that the pulse motor may be operated.
5. The control circuit SC is accommodated to the absence of the control marks 34 on the card 1.

For example, the modification (2) may be achieved by eliminating the flip-flop 62 in FIG. 11 and the gate 99 and flip-flop 96 in FIG. 13. Modification (4) is already described. Modification (5) may be achieved by using a counter and a gate network instead of the flip-flop 88 in FIG 13 so that the flip-flop 83 may be reset to a desired number of pulses. However, modification (3) is somewhat complicated which will be explained below.

According to the second embodiment of the invention, the scanning sensor *c* for scanning the card 1 is shielded by the cover plate 110. As a result, an operator cannot inspect which row is scanned and therefore cannot foresee what needle selection is to be performed in the following operation of the carriage. This leads to the fact that, as a result of undesired feeding operation of the card 1, a part outside the essential region 1*p* containing desired knitting pattern informations is scanned in vain or mirror repeat of a pattern in the vertical direction is undesirably worked. Similar inconvenient operations will result when correction knitting is performed after a wrong knitting is loosened.

Figure 24:
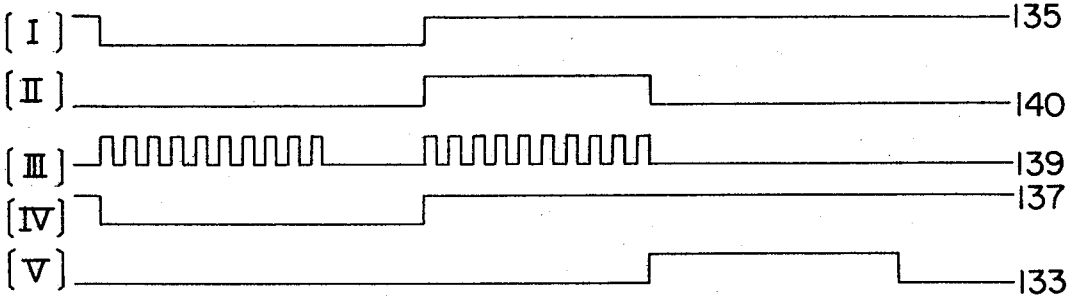
FIG. 24 is a time chart illustrating operations of the respective components of FIG. 23.

In order to eliminate the above-described inconvenience, the program providing system according to the second embodiment of the invention is provided with an appropriate electrical circuit including manually operable input means in the form of a confirmation button 135 (FIG. 20). This circuit makes it possible that a part of the card 1 which actually positioned in the scanning line of the scanning sensor *c* may be automatically pulled back to a predetermined confirmation position where an operator can inspect the relevant part with naked eye and then returned to the scanning position. The button 135 is, for example, of so-called a double-action structure and is combined with a switch which can be turned on or off in response to the pressing of the button 135, for example, turned ON at a first pressing of the button and resumes OFF at a second pressing as shown in FIG. 24 [I].

Figure 23:
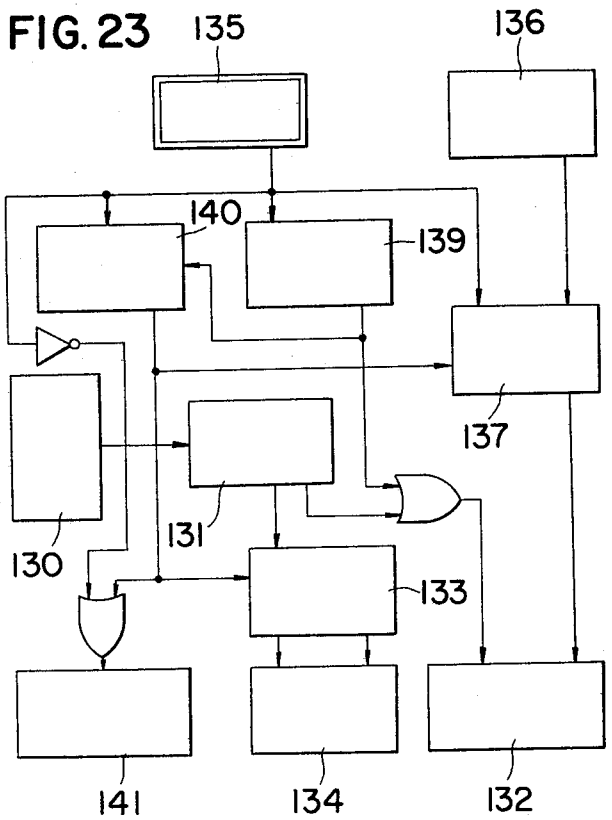
FIG. 23 is a block diagram illustrating an electrical construction of the scanner.

The configuration of said circuit is shown in FIG. 23, which is obtained by partially modifying the feed/scan control circuit SC of the circuit configuration in FIG. 13. A part necessary to explain such modification is only illustrated in FIG. 23.

The circuit comprises a pulse generator 139 for generating a predetermined number of pulses each time the output of the said switch (135) is reversed, the pulse generator being connected to a driver 132 for driving the pulse motor *m* to give said pulses thereto; a detection circuit 140 for obtaining a detection signal representing that the pulse motor *m* is working on the card 1 after the second pressing of the button 135, the circuit being consisting of a counter, gate circuits and a flip-flop; and a feeding direction control circuit 137 for supplying to the driver 132 an output signal to render the feeding direction of the card 1 backward when the switch (135) is ON, or another output signal to render the feeding direction forward when the detection circuit 140 is producing the detection signal, independently of the output of the flip-flop 91 (FIG. 13) for instructing the feeding direction.

This circuit is operated as follows: When the button 135 is pressed at a first time, the switch is turned ON to energize the pulse generator 139, which supplies a predetermined plural number of pulses to the driver 132 as shown in FIG. 24 [III]. The card 1 is thus transferred backward by a predetermined number of rows. This feed amount is set to be equal to the distance between the reference line 118 and the scanning line along a curved path. The part of the card 1 which has been positioned in the scanning line of the scanning sensor *c* is pulled back to the position of the reference line so that an operator can inspect the relevant part of the card 1 through the oblique rear portion 117' of the transparent member 117. As obvious from the above explanation, the number of pulses that the pulse generator 139 produces each time depends upon the feed amount and is set to 10 in this case.

After confirming the relevant part, the operator again presses the button 135. The pulse generator 139 again produces 10 pulses in response to this second pressing. The switching of the switch (135) from ON to OFF resulting from the second pressing actuates the detection circuit 140 which starts to produce its output. The detection circuit 140 stops producing its output when the pulse generator 139 has produced 10 pulses. Accordingly, the feeding direction of the card 1 as a result of the second pressing of the button 135 is forward. According to the 10 pulses from the pulse generator 139, the card 1 is automatically returned or fed forward by the predetermined distance (feed amount). The part of the card 1 which had been positioned in the scanning line of the scanning sensor *c* before the first pressing is again positioned just in the scanning line.

To add to the button 135 a function similar to that of the correction button CB in the first embodiment, the detection circuit 140 is associated with a scanning instruction circuit 133. Upon extinction of the detection signal from the detection circuit 140, the scanning instruction circuit 133 is actuated. As a result, the scanner *b* automatically reciprocates in the same manner as in the first embodiment.

The button 135 can also be used as a start button similar to the start button CB in the first embodiment. The button 135 is, of course, operated after the power switch is turned on. In this condition, the operator inserts the card 1 into the entrance and then turns the adjusting wheel 113 by finger to set the first row of sections on the card 1 to the reference line 118. Then the operator presses the button again. According to this second pressing, the card 1 is automatically fed forward and stopped at the position where the first row coincides with the scanning line of scanning sensor *c*, as explained at above. Thereafter, the scanner *b* starts to reciprocate in the same manner as described as above. Scanning of the first row will transmit the informations concerning the first row of the knitting pattern to the circuit.

The outputs of the detection circuit 140 and the switch combined with the button 135 are also supplied to a display element 141 mounted on the control panel 2 such as an electroluminescent element. The display element 141 is turned on after the part of the card 1 in the scanning line starts the above-described displacement and until said part resumes the starting position. The lit display element permits the operator to confirm that the card 1 is displaced and the carriage should not be operated.

In FIG. 20, the control panel 2 also includes a feeding direction reverse button 143 connected to the feeding direction instruction flip-flop 91 to reverse the output thereof each time the button 143 is pressed, and display elements 144 and 145 connected to said flip-flop 91 to display the feeding direction.

What is claimed is:

1. A providing system for providing electric signals representative of data for selecting knitting needles in a needle bed of a knitting machine comprising, in combination, a frame mounted alongside the needle bed;

a holder rotatably supported on said frame;

a program carrier removably supported on said holder and having thereon a program of a pattern to be knitted;

first drive means including an electromagnetic means for driving said holder to rotate around its axis thereby to incrementally feed the program carrier in one or the other direction;

a guide bar mounted in parallel with said axis;

a member slidably mounted on said guide bar;

a scanning sensor mounted on the slidable member for reading the program on said program carrier along a predetermined scanning line;

second drive means including an electric motor for driving said slidable member to move from one to the other stroke end and vice versa;

pulse generator means for generating an interval pulse each time said slidable member moves an increment; and control means including a control circuit for controlling said first and second drive means to effect feeding of the program carrier in a selected direction and scanning by the scanning sensor.

2. A system as claimed in claim 1, wherein said second drive means comprises a bobbin mounted on said slidable member, a coil wound on said bobbin and electrically connected to said control circuit, and a permanent magnet placed on said frame in parallel with said guide bar and in close relation to said coil, said permanent magnet cooperating with said coil to constitute a linear motor.

3. A system as claimed in claim 2, wherein said bobbin is fitted on said guide bar and said guide bar is of ferromagnetic material.

4. A system as claimed in claim 2 further comprising a magnet piece attached onto said slidable member for urging said slidable member upwardly in cooperation with said permanent magnet.

5. A system as claimed in claim 1 wherein said first drive means comprises a ratchet wheel operatively connected to said holder, a pair of electromagents, and a pair of pawls linked to the respective electromagnets, whereby said ratchet wheel is incrementally rotated in one or the other direction by exciting the corresponding electromagnet.

6. A system as claimed in claim 1 wherein said first drive means comprises a bi-directional step motor having a drive shaft operatively connected to said holder.

7. A system as claimed in claim 6, wherein said first drive means further comprises a manually operable member operatively connected to said holder for feeding said program carrier supported on said holder independent of said step motor.

8. A system as claimed in claim 1 which further comprises a cover member disposed above to shield all the components of the system, said member being provided with a pair of elongated openings parallel with the axis of said holder through which the program carrier can be passed, and a guide member mounted on the said frame to enclose said holder, for guiding said program carrier supported on said holder along a path communicating said elongated openings with each other, said guide member having a plurality of slits formed along the scanning line for exposing the program carrier to said scanning sensor.

9. A system as claimed in claim 8, which further comprises reference means positioned outside said cover member and adjacent to one of said elongated openings in said cover member, said reference means being spaced apart from said scanning sensor by a predetermined distance.

10. A system as claimed in claim 9, wherein said control means further includes manually operable input means and first circuit means for controlling said first drive means to feed the program carrier in response to a manual operation of said input means and independent of a preselected feeding direction, whereby a part of the program carrier located opposite to said reference means is automatically fed to a position coincident with the scanning line of said scanning sensor.

11. A system as claimed in claim 10, wherein said control means further includes second circuit means for controlling said second drive means to move said slidable member from one stroke end to the other stroke end to carry out the scanning by said scanning sensor, subsequent to the feeding operation of the program carrier effected in response to the manual operation of said input means.

12. A system as claimed in claim 10, wherein said first circuit means for controlling said first drive means has another function to feed the program carrier in response to another manual operation of said input means, whereby a part of the program carrier located in the scanning line of said scanning sensor is automatically fed to a position coincident with said reference means.

13. A system as in claim 1 wherein the system is of open construction so that a machine operator can visually observe a part of the program carrier located in the scanning line of scanning sensor, and said control means further includes manually operable input means and third circuit means for controlling said first drive means to feed the program carrier by the predetermined distance in the direction opposite to the preselected feeding direction and for controlling said second drive means to move said slidable member from one stroke end to the other stroke end to perform the scanning by said scanning sensor, subsequent to the above feeding operation.

14. A system as claimed in claim 1, wherein said control means further includes manually operable input means and fourth circuit means for disabling the operation of said first drive means in response to a manual operation of said input means, whereby only the scanning by the scanning sensor is performed in response to movement of the carriage.

15. A system as claimed in claim 1 wherein said control means further includes manually operable input means electrically connected to said control circuit, whereby the feeding direction of the program carrier is selected to be reversed in response to a manual operation of said input means.

16. A system as claimed in claim 1 wherein said control circuit is adapted to control said second drive means to move the slidable member first in one direction to one stroke end and subsequently in the other direction to the other stroke end, and said control means further includes circuit means for cancelling that portion of the output of the said scanning sensor which is associated with the movement of said slidable member in the other direction.

17. A system as claimed in claim 16, wherein said circuit means comprises a switch provided at said one stroke end and adapted to be actuated by said slidable member.

18. A system as claimed in claim 1 wherein the program carrier carries a datum or data concerned with its feeding thereof, and said scanning sensor is electrically connected to said control circuit, whereby as a result of the reading of the datum by said scanning sensor, said control circuit controls said first drive means to operate the latter in accordance with the meaning of the datum.

19. A system as claimed in claim 18, wherein the program carrier carries a datum or data representative of its feeding direction whereby subsequent to the reading of the datum by said scanning sensor, the program carrier is fed in the direction represented by the datum.

20. A system as claimed in claim 18 wherein the program carrier carries data for stopping the feeding operation of said program carrier by said first drive means, whereby once the feeding operation is started, the program carrier is automatically fed until said scanning sensor reads one of said data.

21. A system as claimed in claim 1 wherein the program carrier further carries a datum representative of the unit number of needles to be selected or width of one repeat of a pattern carried on the program carrier, and said control means further includes circuit means electrically connected to said scanning sensor, whereby said circuit means produces electric signals representative of said unit number when said scanning sensor reads said datum.

* * * * *